United States Patent [19]

Matsuyama et al.

[11] Patent Number: 4,912,023

[45] Date of Patent: Mar. 27, 1990

[54] PHOTOGRAPHIC LIGHT-SENSITIVE MATERIALS HAVING AN OIL COMPONENT AND A BLOCK COPOLYMER

[75] Inventors: Junichi Matsuyama; Keiichi Adachi; Yukio Aogaki, all of Ashigara, Japan

[73] Assignee: Fuji Photo Film Co., Ltd., Minami-Ashigara, Japan

[21] Appl. No.: 191,740

[22] Filed: May 2, 1988

Related U.S. Application Data

[63] Continuation of Ser. No. 902,638, Sep. 2, 1986, abandoned.

[30] Foreign Application Priority Data

Sep. 4, 1985 [JP] Japan ..... 60-195656
Nov. 15, 1985 [JP] Japan ..... 60-256409
Feb. 24, 1986 [JP] Japan ..... 61-39759

[51] Int. Cl.[4] ..... G03C 1/76

[52] U.S. Cl. ..... 430/531; 430/627; 430/950; 430/961

[58] Field of Search ..... 430/523, 531, 950, 961, 430/909, 627

[56] References Cited

U.S. PATENT DOCUMENTS 3,022,169 2/1962 Heckelmann et al. ..... 430/961
3,885,969 5/1975 Kruck ..... 430/531
3,920,456 11/1975 Nittel et al. ..... 430/950
4,248,963 2/1981 Kolb et al. ..... 430/523
4,399,213 8/1983 Watanabe et al. ..... 430/950
4,450,230 5/1984 Delfino et al. ..... 430/950

*Primary Examiner*—Jack P. Brammer
*Attorney, Agent, or Firm*—Burns, Doane, Swecker & Mathis

[57] ABSTRACT

The present invention provides a photographic light-sensitive material having at least one silver halide light-sensitive layer and at least one light-insensitive layer on a support, characterized in that the light-sensitive layer and/or the light-insensitive layer contain(s) a water-soluble or water-dispersible block copolymer comprising one component of a polyvinyl alcohol polymer and the other component of an ionic group-containing polymer. The support is preferably a reflective support, and the light-sensitive layer and/or the light-insensitive layer may contain a fluorescent whitening agent. The present photographic material is processed preferably in the presence of a fluorescent whitening agent. The present material forms a print with excellent background whiteness and excellent surface gloss. The appearance is not deteriorated after preservation under high moisture conditions for a long period of time.

25 Claims, No Drawings

PHOTOGRAPHIC LIGHT-SENSITIVE MATERIALS HAVING AN OIL COMPONENT AND A BLOCK COPOLYMER

This application is a continuation of application Ser. no. 902,638, filed Sept. 2, 1986, now abandoned.

FIELD OF THE INVENTION

The present invention relates to photographic light-sensitive materials, especially to silver halide color photographic materials, as well as to the method for the processing of these materials.

BACKGROUND OF THE INVENTION

Color photographic materials for prints, slides, camera shots, instant photographs and the like are generally exposed to various environmental conditions in the manufacture thereof as well as during or after the photographic processing thereof. Therefore, it is difficult to keep the material, which mainly comprises a gelatin component, in the form of an optically uniform film. Often, such exposure results in the occurrence of a fine roughness of the surface of the film or in the reduction of the light transmittance of the film.

These phenomena cause an extreme deterioration in the beauty of the images formed in the photographs with the result being that the planned characteristics of the photographic materials cannot sufficiently be attained.

In such color photographic materials, at least one hydrophilic colloid layer therein contains a large oil component and the adjacent hydrophilic colloid layers do not contain any oil component or contain only a relatively small amount of an oil component. Each layer, however, is not uniformly elastic relative to the variation of the environmental conditions, such as temperature, humidity as well as pH and salt concentration in the processing solutions. Also, the balance of the layers is apt to be lost. Therefore, the aforesaid phenomena will occur very often in color photographic materials.

Under the circumstances, with multilayer color photographic materials having a gelatin film containing a large oil component, it was necessary to severely control the ratio of the oil component to gelatin in each layer so that the ratio does not largely vary in each layer. This was necessary in order to keep a uniform film surface throughout the manufacturing steps of the materials, the taking of photographs therewith, the photographic processing thereof and the preservation of the photographs after the processing, thereby to obtain the photographs of high quality.

However, the incorporation of a large amount of an oil component especially in the outermost surface layer of photographic materials caused the bleeding of the oil component out of the surface layer in the manufacture of the material. Therefore, in practice, the content of the oil component in the outermost surface layer must be low or the outermost surface layer must be free from any oil component.

In order to solve this problem, various means have heretofore been proposed and actually tried. For example, reducing the amount of oil component in the material, controlling the salt concentration in the photographic processing step, controlling the temperature in the processing bath, controlling the drying temperature after the processing step or covering the material with a special protective film so that the material after processing is not directly exposed to the environmental atmosphere.

Further, a polyvinyl alcohol or the graft polymer thereof, as described in Japanese Patent Publication No. 47371/80, has been added to the hydrophilic colloid layer so as to modify the physical and mechanical property of the film.

In the above trails, the former means is insufficient in view of the requirements that the quality of the photographs is to be kept high and that other troubles must not result therefrom. Further, this means is complicated and is not economical.

The latter means where a polyvinyl alcohol or the graft polymer thereof is used, is also defective in that the balance of the layers is not improved but on the contrary the photographic density is reduced and the film surface is not uniform but rough.

Accordingly, the first object of the present invention is to provide photographic light-sensitive materials which are free from the aforesaid problems and which may form excellent images.

The second object of the present invention is to improve the interlayer adhesion of the layers in the photographic materials and to provide materials where the layers are not cleaved in the manufacture thereof or during or after the photographic processing thereof.

The third object of the present invention is to provide photographic materials capable of forming photographic images with excellent gloss in various photographic processing environments such as high temperature and high speed processing and following high temperature drying.

The use of a fluorescent whitening agent for the purpose of improving the whiteness of photographic light-sensitive materials after processing is well known in this technical field. In recent years, photographic light-sensitive materials that are suitable for a simple and rapid processing have been necessary. Therefore, various techniques have been developed therefor. For example, the incorporation of black-and-white developing agents such as hydroquinones, metals and phenidones or color developing agents such as p-phenylenediamine derivatives in the photographic materials, high temperature processing and high speed processing of the materials are included. In high speed processing where the processing time is short, however, the residual coloration of sensitizer colors or dyes is apt to occur. Under these conditions, accordingly, the increment of the whiteness of the materials because of the addition of a fluorescent whitening agent is more and more important in the provision of photographic papers.

It is a matter of course that the fluorescent whitening means may generally be utilized for the purpose of improving the apparent whiteness of the materials, irrespective of the occurrence of the residual coloration therein.

Various methods are known for fluorescent whitening of photographic light-sensitive materials. For example, fluorescent whitening agents have been added to the paper support or to the polyethylene laminate layer thereof or water-soluble fluorescent whitening agents or oil-soluble fluorescent whitening agents have been directly added to a silver halide emulsion layer or to other photographic layers coated on a support. These methods are described in Japanese Patent Application (OPI) No. 117/78 (the term "OPI" as used herein refers to a "published unexamined Japanese patent application"), U.S. Pat. Nos. 3,449,257, 3,501,298 and 3,558,316. There are also methods where a fluorescent whitening agent is dispersed in a polymer or is dissolved and dispersed in a so-called photographic dispersing agent and then is added to the photographic materials. These methods are described in Japanese Patent Publications Nos. 37376/70, 11111/70 and 47043/76, U.S. Pat. Nos. 3,416,923 and 3,418,127. Fluorescent whitening agents such as a water-soluble diaminostilbene derivatives have also been previously incorpoated in a developer solution and the agent is penetrated into the photographic materials when processed with the developer. The conventional methods, however, are defective especially in the case where fluorescent whitening agents are incorporated into the laminate layer of the polyethylene laminate paper which is suitable for rapid processing, because the fluorescent whitening agents are poor in the thermal stability and the agents often decompose in the step of heat extrusion during formation of the laminate layer. Further, the fluorescent agents are poor in heat sublimation resistance, and, therefore, the agents are apt to adhere to the manufacturing apparatus. Moreover, the above methods require the regulation of the amount of the fluorescent whitening agent to be added, if photographic materials which may be applied to various kinds of uses and objects are to be formed. Therefore, it is apparent that considerable time, labor and expense are necessary. Thus, the methods are practically limited and, in fact, can hardly be practiced.

Other methods are known where a fluorescent whitening agent is added to a photographic layer. In particular, there is a method where an oil-soluble fluorescent whitening agent is incorporated in a photographic material since the agent does not flow out and thus is not lost during the development processing of the material. There is also a method where a water-insoluble fluorescent whitening agent is dissolved in an organic solvent and the emulsified dispersion is incorporated in a gelatin layer. This method is described in British Patent 1,072,915.

The aforesaid conventional methods where a water-soluble fluorescent whitening agent is incorporated in the processing solution and is diffused into the photographic material or where the water-insoluble fluorescent whitening agent is added to the photographic material are defective in that the fluorescent whitening agent often precipitates or decomposes. This results in the reduction of the whiteness of the material or rather results in the occurrence of stains in the material when the materials are preserved for a long period of time after the photographic processing thereof. In order to improve the whiteness, the fluorescent strength of the fluorescent whitening agent as well as the fluorescent emission spectrum distribution and optical and thermal stability thereof are important factors.

A number of fluorescent whitening agents with improved fluorescent strength and optical and thermal stability have heretofore been developed. However, there are relatively few compounds which are photographically harmless and are sufficiently effective.

Under these circumstances, both in the method where the water-soluble fluorescent whitening agent is penetrated into the photographic material from the processing solution and in the method where the water-insoluble fluorescent whitening agent is dissolved and dispersed in an oil and is added to the photographic material, it is important to stabilize the fluorescent whitening agent in the layers of the photographic material for a long period of time after the photographic processing of the material.

A number of compounds are added to the highly efficient photographic materials, and a number of compounds are also added to the developer and other processing solutions. It is known that these additive compounds include a compound having a quenching activity.

When the photographic light-sensitive materials are processed and preserved, stabilizing the fluorescent whitening agent-containing polymer film thereof under environmental circumstances is an important factor for retaining the effect of the fluorescent whitening agent for a long period of time.

In order to keep the efficient effect of the fluorescent whitening agent in the materials, a technique is known to add a polyvinyl pyrrolidone or polyvinyl alcohol to the gelatin binder which is generally used in the photographic materials. This technique is described in Japanese Patent Publication No. 7127/59. The addition of such polymers has various problems, however, including the occurrence of development inhibition, a reduction in the film strength of the photographic layers, the formation of rough surfaces after photographic processing, a deterioration of adhesion strength of the photographic layers and the occurrence of haze on the film surface.

Accordingly, the fourth object of the present invention is to develop silver halide photographic materials which are free from the aforesaid problems and which may form prints with excellent background whiteness.

The fifth object of the present invention is to develop the silver halide photographic materials which may form prints with excellent background whiteness by rapid development processing.

The sixth object of the present invention is to develop silver halide photographic materials which may form prints with less reduction of the background whiteness during the preservation of the materials.

The seventh object of the present invention is to develop silver halide photographic materials capable of forming prints where the fluorescent whitening agent contained therein does not precipitate during the preservation of the materials.

The eighth object of the present invention is to provide a method for processing photographic materials for the formation of prints with excellent background whiteness.

The ninth object of the present invention is to provide prints with excellent background whiteness.

SUMMARY OF THE INVENTION

The present invention provides a photographic light-sensitive material having at least one silver halide light-sensitive layer and at least one light-insensitive layer, which is characterized in that the light-sensitive layer and/or the light-sensitive layer contain(s) a water-soluble or water-dispersible block copolymer comprising one component which is a polyvinyl alcohol polymer and another component which is an ionic group-containing polymer, whereby the aforesaid first to third objects of the present invention may effectively be attained. (The copolymer is hereinafter referred to as the "block copolymer of the present invention".)

The present invention further provides a photographic light-sensitive material having at least one silver halide light-sensitive layer and at least one light-insensitive layer on a reflective support, in which the light-sensitive layer and/or the light-insensitive layer contain(s) the block copolymer of the present invention in an amount of 0.5 to 40% by weight of the binder in the layer(s).

The present invention also provides for a method for the photographic processing of the material in the presence of a fluorescent whitening agent, whereby the aforesaid fourth to ninth objects of the present invention may effectively be attained.

DETAILED DESCRIPTION OF THE INVENTION

The photographic light-sensitive materials of the present invention will now be explained in greater detail.

One preferred embodiment of the present invention is a photographic light-sensitive material having at least one silver halide light-sensitive layer and at least one light-insensitive layer on a support. All of these layers contain a hydrophilic colloid and at least one of the hydrophilic colloid layers contains an oil component. The oil component-containing layer or the light-sensitive layer and/or the light-insensitive layer which is (are) adjacent thereto contain(s) the block copolymer of the present invention, each of the adjacent layer(s) being a hydrophilic colloid layer.

Some preferred embodiments are given hereunder to show the relation between the oil component-containing hydrophilic colloid layer and the hydrophilic colloid layer containing the block copolymer of the present invention in the photographic light-sensitive material having at least two hydrophilic colloid layers as coated on at least one surface of the support, which are, however, not whatsoever limitative.

(1) The oil component is contained in a hydrophilic colloid layer coated over the furthermost light-sensitive layer from the support. The block copolymer of the present invention is incorporated in a protective layer (hydrophilic colloid layer) superposed over the oil-containing layer.

(2) The oil component is incorporated in a light-sensitive layer (hydrophilic colloid layer). The block copolymer of the present invention is incorporated in an adjacent intermediate layer, protective layer or other hydrophilic colloid layer.

(3) The oil component is incorporated in a hydrophilic colloid layer containing a dye-forming compound. The block copolymer of the present invention is incorporated in an adjacent hydrophilic colloid layer.

(4) The oil component is incorporated in an intermediate layer. The block copolymer of the present invention is incorporated in an adjacent hydrophilic colloid layer.

The block copolymer of the present invention is most effectively incorporated in a protective layer of the color photographic material.

The amount of the block copolymer of the present invention to be incorporated is preferably 0.5 to 40% by weight of the total solid content of the gelatin, which is a main binder and constituent of the hydrophilic colloid layer, and is more preferably 2 to 10% by weight. If the content of the block copolymer is more or less, the improvement of the surface gloss of the material becomes insufficient.

The gelatins which may be used in the present invention include lime-treated gelatins, acid-treated gelatins, and enzyme-treated gelatins as described in *Bull. Soc. Sci. Phot. Japan,* No. 16, page 30 (1966). Gelatin derivatives such as gelatin phthalide or gelatin malonate may also be used. The use of an acid-treated gelatin is preferred.

On the other hand, the amount of the oil component to be incorporated may vary depending upon the kind of oils, and, therefore, the amount may fall within a broad range of 10 to 200% by weight of the gelatin constituting the hydrophilic colloid layer.

The block copolymer to be used in the present invention may be prepared in any known method. For instance, a preferred method is radical polymerization of a radical polymerizable monomer having an ionic group in the presence of a polyvinyl alcohol polymer having a terminal mercapto group as described in Japanese Patent Application (OPI) No. 189113/84.

The preparation of the terminal mercapto group-containing polyvinyl alcohol polymer is described in the aforesaid patent specification, and is described in more detail in Japanese Patent Application (OPI) No. 187003/84.

The radical polymerizable monomer having an ionic group is a vinyl monomer having an ionic group which is compatible with gelatins, such as a carboxyl group, a sulfuric acid group, a sulfonic said groups or a phosphonic acid group. Examples include acrylic acid, methacrylic acid, itaconic acid, maleic acid, fumaric acid, 2-acryloyloxyethyl phosphate, vinyl sulfate, vinyl sulfonate, 2-acrylamidopropane sulfonate, p-styrene sulfonate and metal salts and ammonium salts thereof.

Ionic group-containing polymers are formed by the homopolymerization or copolymerization of the aforesaid ionic group-containing monomers or optionally by copolymerization of the monomers with other radical-copolymerizing nonionic monomers. It is preferred that the ionic group-containing polymers to be used in the present invention do not contain any hydrophobic olefinic unsaturated compound therein in order to effectively attain the objects of the present invention.

Examples of the radical-copolymerizing nonionic monomers are olefins (such as ethylene, propylene and isobutylene), halogenated olefins (such as vinyl chloride, vinyl fluoride, vinylidene chloride and vinyldene fluoride), vinyl esters (such as vinyl formate, vinyl acetate and vinyl propionate), acrylates and methacrylates (such as methyl (meth)acrylate, ethyl (meth)acrylate, butyl (meth)acrylate, 2-ethylhexyl (meth)acrylate, dodecyl (meth)acrylate and 2-hydroxyethyl (meth)acrylate), acrylamide monomers (such as acrylamide, methacrylamide, N-methylolacrylamide and N,N-dimethylacrylamide), styrene monomers (such as styrene and α-methylstyrene), and N-vinylpyrrolidone.

The polyvinyl alcohol polymer preferably contains 50 mol% or more, preferably 70 mol% or more, vinyl alcohol unit (recurring units), and other components therein may be the aforesaid ionic monomer unit. The polymer may contain any other nonionic monomer unit, but it is preferred that the polymer does not contain such nonionic monomer unit in view of the objects of the present invention.

The content of the ionic group in the ionic polymer is preferably at least 0.5 mol%, more preferably 1 mol% or more, and more preferably 2 mol% or more, so that the ionic polymer may be soluble or dispersible in water.

The ratio by weight (A/B) of the polyvinyl alcohol polymer component (A) and the ionic group-containing polymer component (B) in the block copolymer to be used in the present invention is not particularly critical, but is preferably about 0.2 to 50, more preferably 0.3 to 40, most preferably 2 to 10, whereupon the compatibility of the copolymer with gelatins is good and the objects of the present invention can effectively be attained. The molecular weight of the block copolymer is preferably 10,000 to 100,000.

The oil component which may be used in the present invention is one capable of being dispersed in the hydrophilic colloid layer to form oil liquid drops therein. The oil component is preferably liquid at room temperature, comprising substantially water-insoluble oil drop particles. The size of the oil drops is generally 0.01 to 20 microns, and the typical average particle size is 0.1 to 10 microns.

Various photographic additives are useful as the oil component, for example, ultraviolet absorbents, organic solvents for dispersion, color stain inhibitors, color couplers, discoloration inhibitors, lubricants and surfactants.

Examples of liquid ultraviolet absorbents are 2-(2'-hydroxyphenyl)benzotriazole compounds such as those described in Japanese Patent Application (OPI) No. 142975/82, Japanese Patent Publication No. 36984/80, U.S. Pat. Nos. 3,794,493 and 4,518,686.

Among the 2-(2'-hydroxyphenyl)benzotriazole compounds, those having a melting point of 15° C. or lower are preferred.

The 2-(2'-hydroxyphenyl)benzotriazole compounds which are liquid at room temperature are preferably selected from those represented by the following general formula (I):

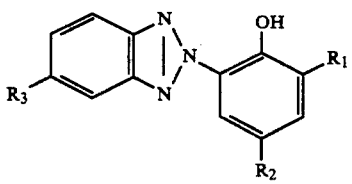

(I)

wherein $R_1$ and $R_2$ each represents an alkyl group, an aryl group, an alkoxy group or an aryloxy group; and $R_3$ represents a hydrogen atom, a chlorine atom, an alkykl group, an aryl group, an alkoxy group, an aryloxy group, an alkenyl group, a nitro group or a hydroxyl group.

Among the compounds of the formula (I), those as selected from the compounds of the following general formulae (II) through (VI) are especially preferred:

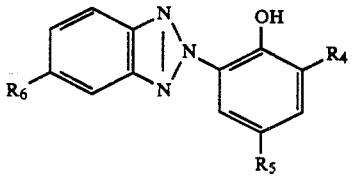

(II)

wherein $R_4$ represents a methyl, ethyl or propyl group; $R_5$ represents a secondary alkyl group having 4 to 10 carbon atoms; and $R_6$ represents a hydrogen atom, a halogen atom or an alkyl or alkoxy group having 1 to 8 carbon atoms.

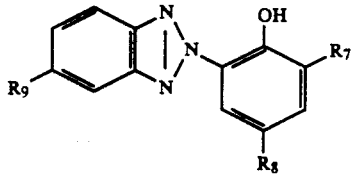

(III)

wherein $R_7$, $R_8$ and $R_9$ each represents an alkyl group having 4 to 10 carbon atoms, with the proviso that at least one of these alkyl groups is a secondary alkyl group.

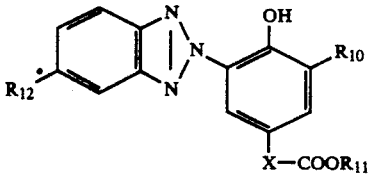

(IV)

wherein $R_{10}$ represents a secondary or tertiary alkyl group having 1 to 8 carbon atoms; X represents an alkylene group having 1 to 6 carbon atoms; $R_{11}$ represents an alkyl group having 1 to 12 carbon atoms; and $R_{12}$ represents a hydrogen atom or an alkyl or alkoxy group having 1 to 8 carbon atoms.

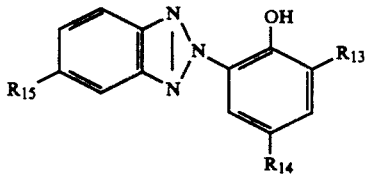

(V)

wherein $R_{13}$ and $R_{14}$ each represents a secondary or tertiary alkyl group having 4 to 10 carbon atoms; and $R_{15}$ represents a hydrogen atom or an alkyl or alkoxy group having 1 to 8 carbon atoms.

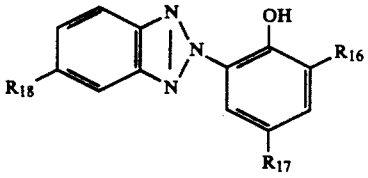

(VI)

wherein $R_{16}$ represents a secondary alkyl group having 4 to 10 carbon atoms; $R_{17}$ represents an alkyl group having 1 to 10 carbon atoms; and $R_{18}$ represents a hydrogen atom or an alkyl or alkoxy group having 1 to 8 carbon atoms.

Examples of compounds as falling within the scope of the aforesaid general formula (I) are given hereunder:

1.

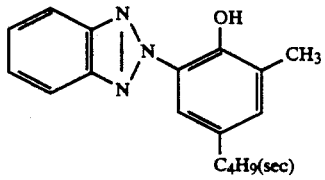

-continued
2.
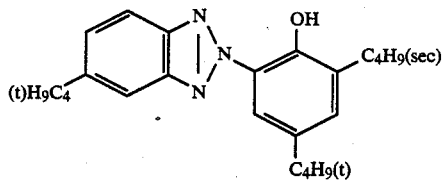
3.
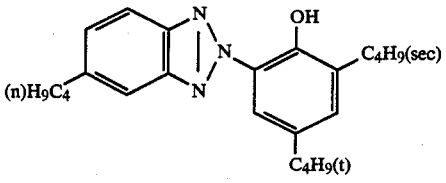
4.
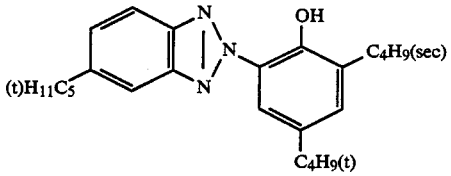
5.
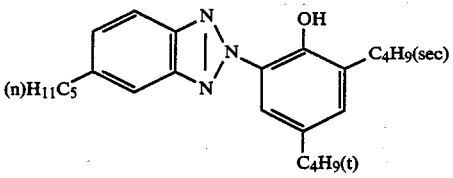
6.
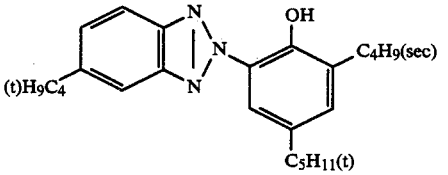
7.
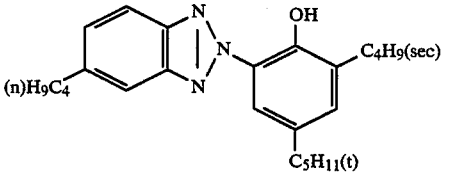
8.
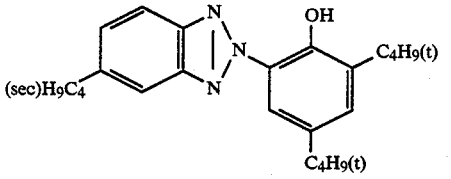
9.
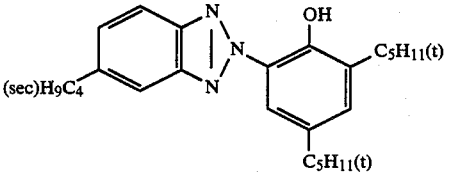
-continued
10.
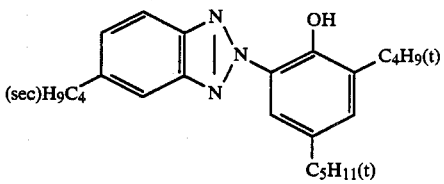
11.
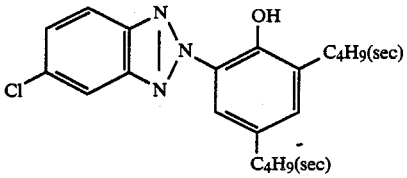
12.
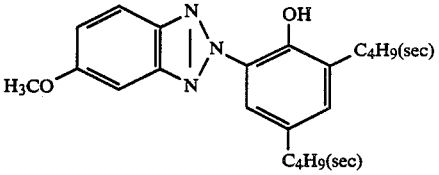
13.
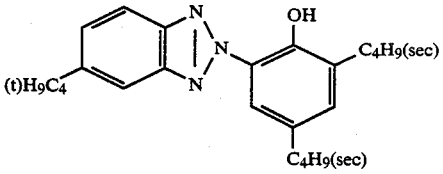
14.
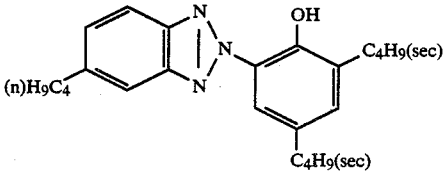
15.
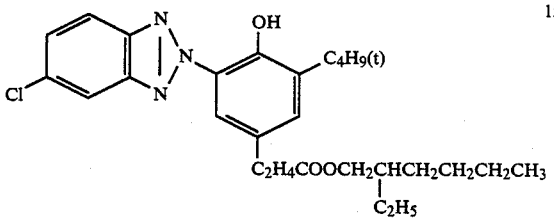
16.
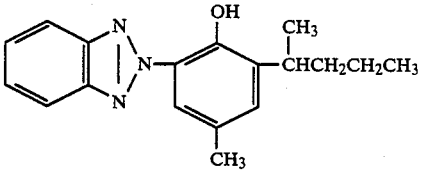
17.
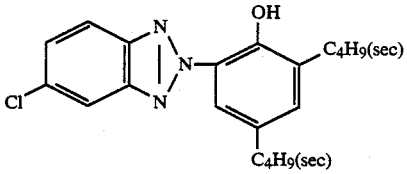

-continued

18.

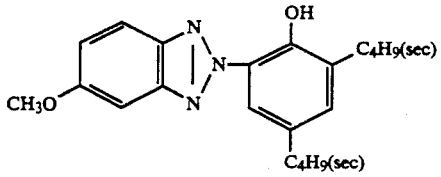

19.

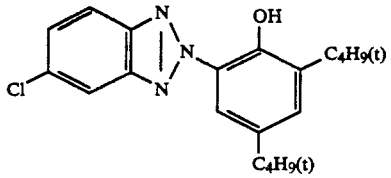

20.

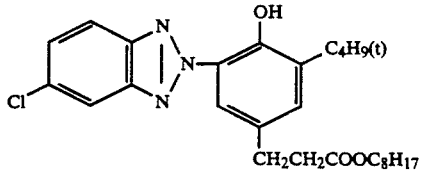

21.

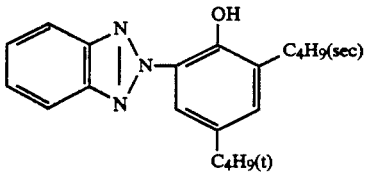

The ultraviolet absorbent which is liquid at room temperature may singly be incorporated in the hydrophilic colloid layer or a mixture of two or more absorbents may be incorporated therein. Further, the ultraviolet absorbent which is liquid at room temperature may be co-used with an ultraviolet absorbent which is solid at room temperature. Examples of the ultraviolet absorbents which are solid at room temperature are other 2'-(2'-hydroxyphenyl)benzotriazole absorbents such as those described in U.S. Pat. No. 4,518,686.

The total amount of the ultraviolet absorbent to be used in the present invention is preferably 0.1 to 5 g/m$^2$, more preferably 0.5 to 2 g/m$^2$.

The organic solvents for dispersion are preferably those having a boiling point of about 175° C. or higher. Examples of such compounds are described in U.S. Pat. Nos. 2,322,027, 2,533,514, 2,882,157, 2,353,262, 3,676,142 and 3,700,454, Japanese Patent Publication No. 23233/71, Japanese Patent Application (OPI) Nos. 82078/75, 27921/76 and 141623/71 and British Patents 958,441 and 1,222,753.

Examples of suitable high boiling organic solvents include phthalates (such as dibutyl phthalate, dicyclohexyl phthalate, di-2-ethylhexyl phthalate and decyl phthalate), phosphates and phosphonates (such as triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate and di-2-ethylhexylphenyl phosphonate), benzoates (such as 2-ethylhexyl benzoate, dodecyl benzoate and 2-ethylhexyl p-hydroxybenzoate), amides (such as diethyldodecanamide and N-tetradecylpyrrolidone), and alcohols and phenols (such as isostearyl alcohol and 2,4-di-tert-amylphenol), aliphatic carboxylic acid esters (such as dioctyl azelate, glycerol tributyrate, isostearyl lactate and trioctyl citrate), aniline derivatives (such as N,N-dibutyl-2-butoxy-5-tert-octylaniline) and hydrocarbons (such as paraffin, dodecylbenzene and diisopropylnaphthalene).

The liquid color stain inhibitors may be selected from various kinds of hydroquinone derivatives, including mixtures thereof. More precisely, they are selected from hydroquinone compound mixtures where the 2,5- or 2,6-positions of the benzene ring are substituted by two tertiary alkyl groups having 15 carbon atoms, as described in British Patent 2,005,040B; secondary dodecylhydroquinone isomer mixtures as described in U.S. Pat. No. 3,700,453; and 2-acylhydroquinone derivative mixtures as described in U.S. Pat. No. 4,366,236.

Examples of lubricants are sodium higher alkyl sulfates, esters of higher fatty acids and higher alcohols, polyethylene glycols of higher molecular weight, higher alkyl phosphates and silicone compounds.

The liquid surfactants to be used as an antistatic agent or coating assistant agent may be selected from alkylene oxide derivatives such as polyethylene oxide and polypropylene oxide derivatives.

Examples of the alkylene oxide derivatives are polyethylene glycol, polyethylene glycol/polypropylene glycol condensation products, polyethylene glycol alkylethers, polyethylene glycol alkylarylethers, polyethylene glycol esters, polyethylene glycol sorbitan esters, polyalkylene glycol alkylamines or amides and silicone/polyethylene oxide adducts.

The liquid couplers and color stain inhibitors may be selected from conventional non-crystallizing compounds, or crystallizing compounds, if they are used without crystallizing.

Typical examples of the organic stain inhibitors are hydroquinones, 6-hydroxychromans, 5-hydroxycoumarans, spirochromans, p-alkoxyphenols, bisphenols and other hindered phenols; gallic acid derivatives, methylenedioxybenzenes, aminophenols, hindered amines; as well as ether or ester derivatives thereof where the phenolic hydroxyl group is silylated or alkylated. Further, metal complexes such as (bis-salicylaldoximato)-nickel complexes and (bis-N,N-dialkyldithiocarbamato)nickel complexes may also be used.

For the prevention of the deterioration of yellow color images by heat, moisture and light, compounds having both partial structures of a hindered amine and a hindered phenol in 1 molecule are effective. These are described in U.S. Pat. No. 4,268,593. For preventing the deterioration of magenta color images, especially the deterioration thereby by light, spiroindanes as described in Japanese Patent Application (OPI) No. 159644/81 as well as hydroxy diether or monoether-substituted chromans are especially effective.

The block copolymer of the present invention is preferably incorporated in the protective layer or in the outermost layer. There are various embodiments of photographic materials having such layer constitution. It is most preferred to incorporate the present block copolymer in the protective layer or the outermost layer of photographic materials having the constitution where a ketomethylene yellow coupler-containing silver halide emulsion layer and a 5-pyrazolone or pyrazoloazole magenta coupler-containing silver halide emulsion layer are provided on a reflective support, a phenol or naphthol cyan coupler-containing silver halide emulsion layer is provided on the furthermost side from the support, a first light-insensitive layer and a second light-insensitive layer are provided adjacent to the cyan coupler-containing silver halide emulsion layer each on the opposite side of the support or on the same side as the support, respectively, and one or more 2-(2'-hydroxyphenyl)benzotriazole ultraviolet absorbents which are solid or liquid at room temperature are incorporated at least in the first light-insensitive layer. The ultraviolet absorbent to be incorporated in the second light-insensitive layer may be any one of 2-(2'-hydroxyphenyl)benzotriazole compounds or other ultraviolet absorbents. In the case where the 2-(2-hydroxyphenyl)-benzotriazole compounds are not oily, they may be dispersed in the hydrophilic colloid, or if they are oily, they are first dissolved in the aforesaid high boiling solvents and they may be dispersed in the hydrophilic colloid. Another protective layer may be provided on the first light-insensitive layer.

The layer constitution of the above photographic materials as well as couplers and ultraviolet absorbents to be used therein are described in detail in Japanese Patent Application (OPI) Nos. 208745/83, 209734/83, 211147/83, 209735/83, 214152/83 (U.S. Pat. No. 4,518,686) and 221844/83.

Another embodiment of the photographic materials to which the present invention may be applied is a light-insensitive hydrophilic colloid layer-containing light-sensitive material, as described in Japanese Patent Publication No. 8346/81. In this embodiment, a light-insensitive hydrophilic colloid laminate layer comprising plural light-insensitive hydrophilic colloid layers is provided as the outermost layer and oil drops are incorporated in at least one of these plural layers in such a way that the density of the oil drops as incorporated in the outermost layer among these plural layers must not be maximum relative to the density of the oil drops contained in each of the plural layers.

The density of the oil drops is defined to be a ratio of the total volume of the oil drops as added to the light-insensitive hydrophilic colloid layers to the total volume of the binder as incorporated in the layers. This is hereinafter referred to as the ratio of "oil/binder". The thickness of the outermost layer as coated in this embodiment is generally 0.2 to 5 microns, preferably 0.5 to 3 microns.

The preferred density of the oil drops in the outermost layer varies depending upon the kind and size of the oil drops, the kind and property of the binder as contained in the coated light-insensitive hydrophilic colloid layers and the dried state of the photographic material containing the light-insensitive hydrophilic colloid layers. The density is desirably in the range of about, oil/binder=0.3 or less, especially in the range of about, oil/binder=0.15 or less.

Still another embodiment of the photographic materials to which the present invention may be applied is a silver halide photographic material having at least one silver halide emulsion layer and at least one protective layer or a light-insensitive hydrophilic colloid layer on a support as described in Japanese Patent Publication No. 9053/82. In this embodiment, the protective layer is a laminate layer comprising plural light-insensitive hydrophilic colloid layers. At least one layer of these plural layers contains oil drops and the outermost layer of the protective laminate layer contains a matting agent. The film thickness of the outermost layer is ¼ or less of the average particle size of the matting agent.

Matting agents which may be used include inorganic substances such as silica, magnesium oxide, titanium dioxide or calcium carbonate as well as organic substances such as polymethyl methacrylate, cellulose acetate propionate and alkali-soluble porous polymer particles comprising acrylic acid and methyl acrylate (as described in Japanese Patent Application (OPI) No. 135958/56). The size of the particles is preferably about 0.1 to 20 microns, preferably 0.5 to 10 microns. In particular, the matting agent is most preferably polymethyl methacrylate or silica having an average particle size of 1 to 8 microns.

In this embodiment, the film thickness of the protective layer is generally 0.1 to 5 microns and is preferably 0.5 to 3 microns. The thickness of the outermost layer of the protective laminate layer varies depending upon the kind of the binder, the particle size of the matting agent and the degree to be matted. The thickness is generally 3 microns or less, preferably 1 micron or less.

The content of the oil drops as contained in the outermost layer of the plural layers and constituting the protective laminate layer is preferably less than 0.2 relative to the binder volume. The protective layers other than the outermost layer preferably contain oil drops, the content of which is 0.1 or more, preferably 0.2 to 0.8.

The content of the oil drops as described in this embodiment is defined to be a ratio of the total volume of the oil drops as added to the light-insensitive hydrophilic colloid layers to the total volume of the binder as incorporated in the layers.

Still another embodiment of the photographic materials to which the present invention may be applied is a silver halide photographic material having at least one light-sensitive silver halide emulsion layer and an outermost layer of a two-layer laminate light-insensitive hydrophilic colloid layer (protective layer) provided on the same side of a support, as described in Japanese Patent Publication No. 24456/85.

In this embodiment, oil drops are incorporated in one of the aforesaid light-insensitive hydrophilic colloid layers are positioned in the outer side relative to the support and a powder of fine particles is incorporated in the other light-insensitive hydrophilic colloid layer as positioned in the inner side relative to the support. The ratio of the film thickness of the inner side layer of these light-insensitive hydrophilic colloid layers to that of the outer side layer is 1.5 or more.

The content of the oils to be incorporated in the upper light-insensitive hydrophilic colloid layer (protective layer) is preferably within the range of 0.1 to 0.4, relative to the binder volume.

The powder of fine particles to be incorporated in the lower light-sensitive hydrophilic colloid layer (protective layer) in this embodiment is a powder comprising organic or inorganic compound particles having an average particle diameter of 0.0005 micron or more, preferably 0.02 to 3.0 microns.

The fine particle powder may be an organic or inorganic matting agent, a polymer latex or a colloidal silica.

Examples of the powder are organic compounds such as copolymers of acrylates or methacrylates, cellulose acetate propionate and polystyrene; and inorganic compounds such as silver halides, strontium sulfate, barium sulfate, calcium carbonate as well as crystalline oxides such as $SiO_2$ (silica), ZnO, $TiO_2$, $Al_2O_3$, MgO or BaO and complex oxides thereof. The silver halides may be any conventional ones which are generally used in silver halide photographic emulsions, including silver bromide, silver chloride, silver bromoiodide, silver bromochloride and silver bromoiodochloride.

The fine particle powder as used in this embodiment is preferably silicon dioxide (silica), which may contain a small component of alumina or sodium aluminate. The silica may be a colloidal silica dispersed in a main dispersion medium of water. The colloidal silica may also contain a stabilizer of an alkali component selected from inorganic salts such as sodium hydroxide, potassium hydroxide, lithium hydroxide or ammonium hydroxide or organic salts such as tetramethylene ammonium ion.

The amount of the fine particles powder to be incorporated is preferably 3 to 50% by weight of the gelatin as contained in the lower light-insensitive hydrophilic colloid layer (protective layer), or, that is, the coated amount thereof is preferably 0.02 to 0.5 g/m$^2$.

Regarding the film thickness of the light-insensitive hydrophilic colloid layer (protective layer) comprising the aforesaid two layers, the total film thickness is not specifically limiting, but the effect of the present invention becomes more remarkable when the film thickness of the lower protective layer is thicker than that of the upper protective layer. In particular, the ratio of the film thickness of the lower protective layer to that of the upper protective layer is preferably 1.5 or more.

In this embodiment, the upper light-insensitive photographic colloid layer (protective layer) is a substantial surface layer of the silver halide photographic light-sensitive material, and this may contain a matting agent comprising an inorganic substance such as silica, titanium dioxide or magnesium oxide or an organic substance such as polymethyl methacrylate or cellulose acetate propionate. Further, it may contain a colloidal silica dispersion, or may contain silver halide fine particles which are not substantially developed, such as those described in U.S. Pat. Nos. 3,050,391 and 3,140,179. The power protective layer may further contain the oil drops as added to the upper protective layer.

The block copolymer of the present invention may be incorporated in at least one light-insensitive hydrophilic colloid layer in the aforesaid embodiments. Further, this may be co-used together with the organic fluoro compound as described in the aforesaid Japanese Patent Publication Nos. 8346/81 and 9053/82.

Other preferable photographic materials to which the present invention may be applied are those having at least one silver halide light-sensitive layer and at least one light-insensitive layer or a reflective support, where the light-sensitive layer and/or the light-insensitive layer contain(s) the block copolymer of the present invention in an amount of 0.5 to 40% by weight of the binder in the layer(s).

The aforesaid fourth to ninth objects of the present invention may effectively be attained by photographic processing of the material in the presence of a fluorescent whitening agent.

The fluorescent whitening agents which may be used in the present invention are compounds such as those described in *The Chemistry of Synthetic Dyes* (written by K. Veen Rataraman), Vol. V. Chap. 8. More specifically, stilbene compounds, courmarin compounds, biphenyl compounds, benzoxazolyl compounds, naphthylimide compounds, pyrazoline compounds and carbostyryl compounds may be used.

If the fluorescent whitening agent to be used in the present invention is water-soluble, it may directly be added to the light-sensitive material in the form of an aqueous solution, or as the case may be, it may be first added to a processing solution (such as the developer, bleaching solution, fixer, bleaching-fixer, rinsing solution, stabilizer or any other desired processing solution) and penetrated into the light-sensitive material during the processing procedure thereof. If the fluorescent whitening agent is insoluble in water, it may be first dissolved in a high boiling organic solvent and the resulting solution added to the light-sensitive material. The fluorescent whitening agents of the present invention are preferably water-soluble ones in view of the step for the manufacture of the photographic materials. Specific examples are given hereunder, which, however, are not intended to be limiting.

1

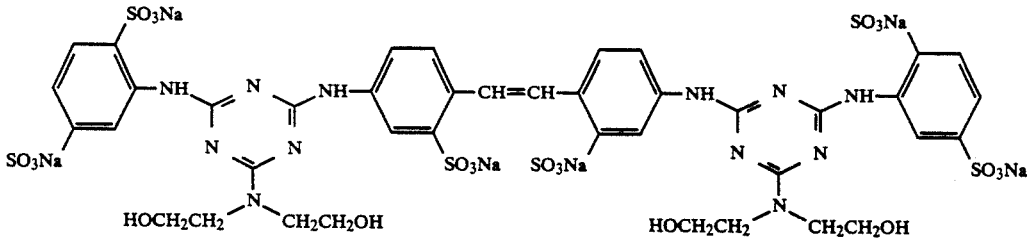

2

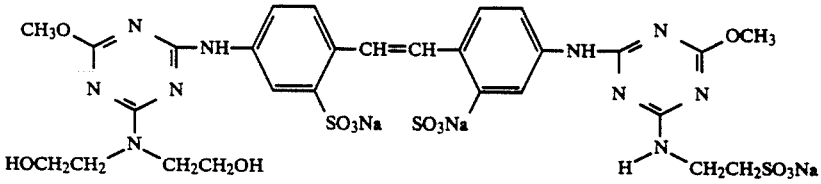

3

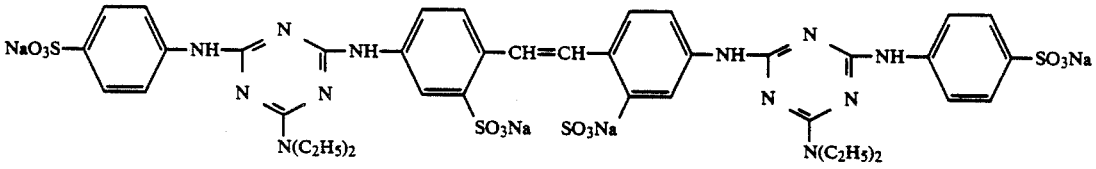

-continued
4
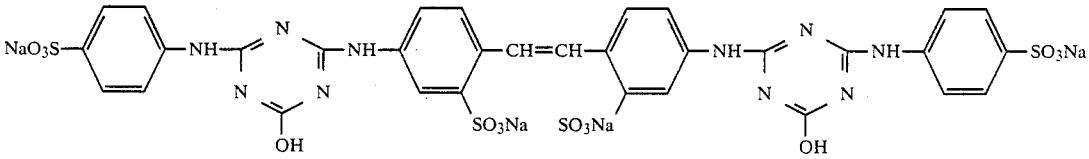
5
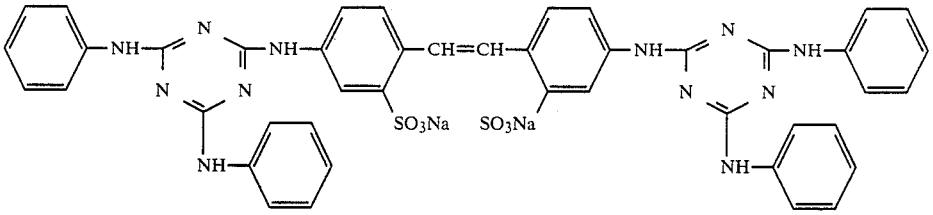
6
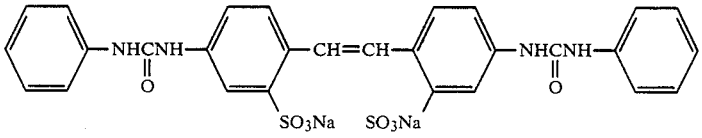
7
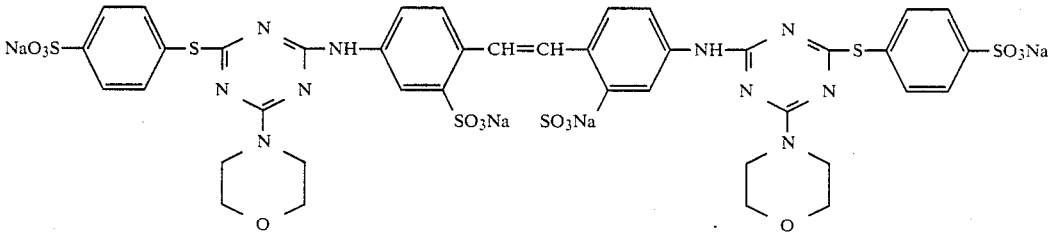
8
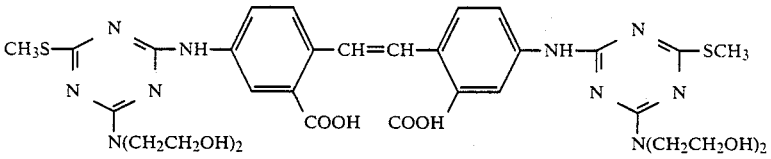
9
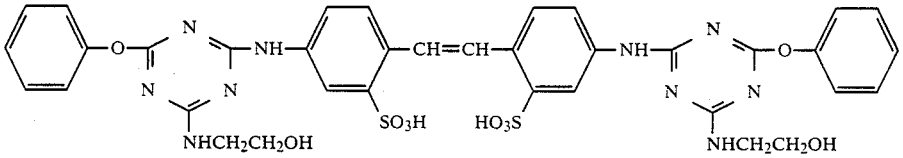
10
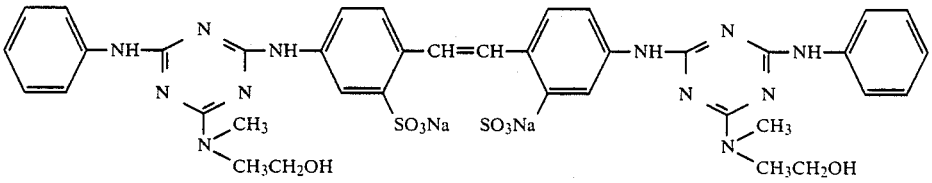
11
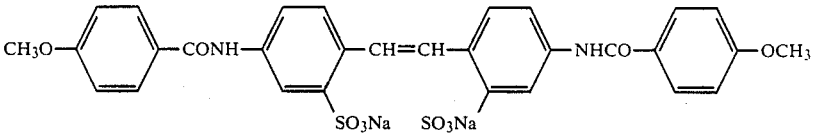
12
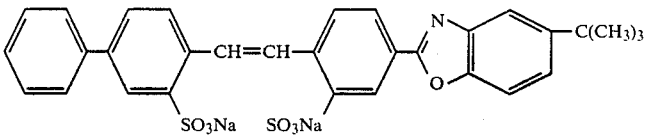

-continued
13
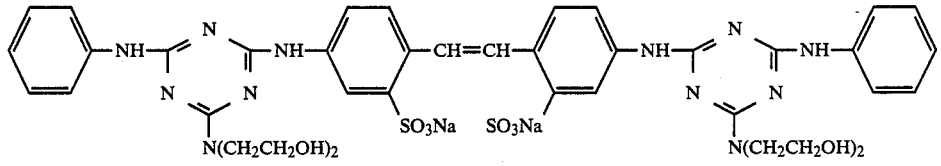
14
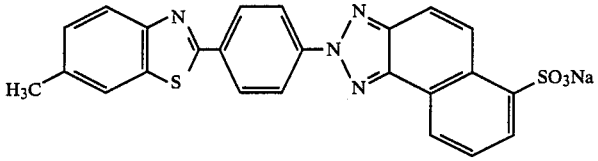
15
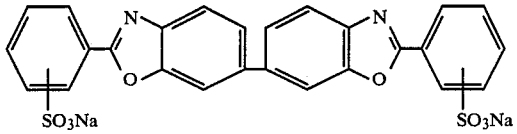
16
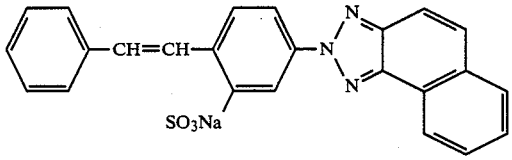
17
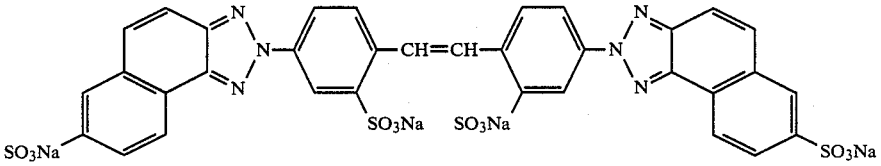
18
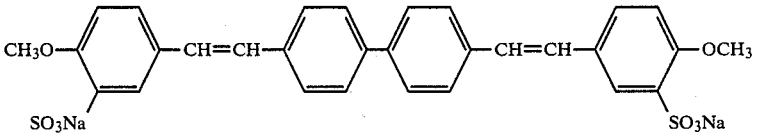
19
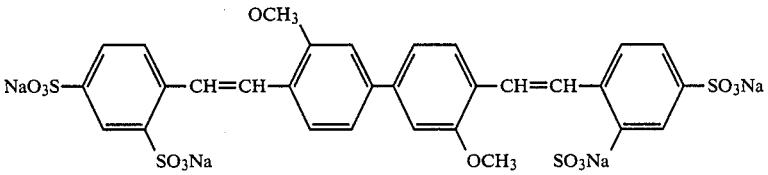
20
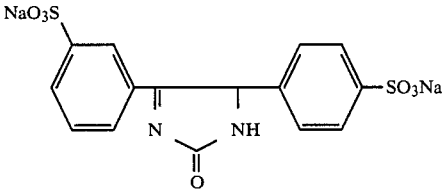
21
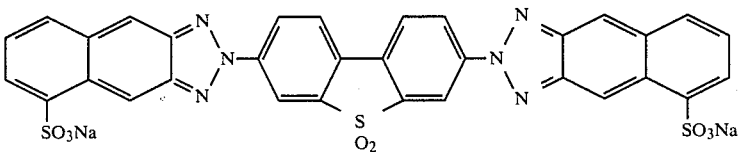

-continued
22
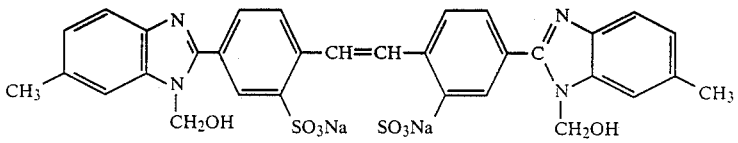
23
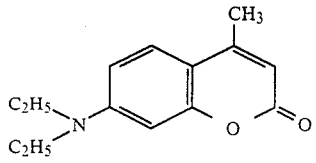
24
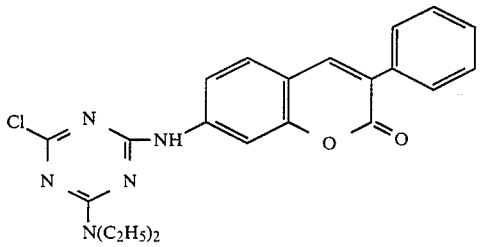
25
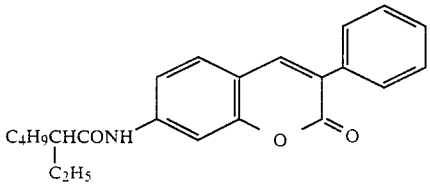
26
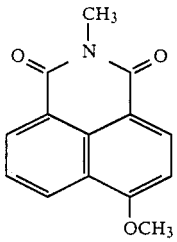
27
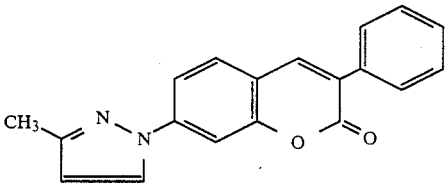
28
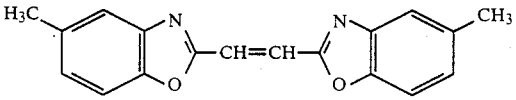
29
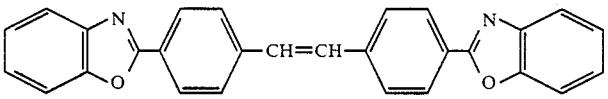
30
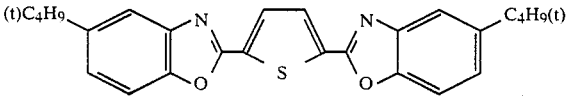
When a water-insoluble fluorescent whitening agent is added, a high boiling organic solvent is used as described in the above explanation, and, for example, the method as described in U.S. Pat. No. 2,322,027 may be used. For instance, the fluorescent whitening agent is first dissolved in a single high boiling organic solvent selected from alkyl phthalates (such as dibutyl phthalate and dioctyl phthalate), phosphates (such as tricresyl phosphate and dioctylbutyl phosphate), citrates (such as tributyl acetyl citrate), benzoates (such as octyl benzoate), alkylamides (such as diethyllaurylamide), fatty acid esters (such as dibutoxyethyl succinate), trimesates (such as tributyl trimesate) and chlorinated paraffins (such as Enpara 40*RTM* by Ajinomoto Co.). These solvents may also be co-used with an organic solvent having a boiling point of about 30° C. to 150° C. such as ethyl acetate, butyl acetate or the like lower alkyl acetates or ethyl propionate, secondary butyl alcohol, methyl isobutyl ketone, cyclohexanone or methyl cellosolve acetate. The resulting solution is then dispersed in the hydrophilic colloid (such as a surfactant-containing gelatin aqueous solution) by the use of an emulsifier apparatus.

The amount of the fluorescent whitening agent to be incorporated in the final photographic material is 0.1 to 200 mg/m$^2$ and most preferably 5 to 50 mg/m$^2$. When a water-soluble fluorescent whitening agent is used, the amount of the agent to be added to the processing solution is regulated so that the content of the flourescent whitening agent in the final photographic material may be the aforesaid amount.

When the fluorescent whitening agent is incorporated into the photographic material, the agent may be added to either the silver halide emulsion layer (light-sensitive layer) or the light-insensitive hydrophilic colloid layer. The agent is preferably added to the light-sensitive layer or to the light-insensitive layer which is positioned on the upper side from the light-sensitive layer (or furthest from the support).

Gelatins are preferably used as the binder or protective colloid in the emulsion layer or hydrophilic colloid layer in the photographic material of the present invention. Any other hydrophilic colloid may of course be used therefor.

For example, various kinds of synthetic hydrophilic high molecular weight substances may be used, including proteins such as gelatin derivatives, graft polymers of gelatin and other high molecular weight substances, albumins, caseins, cellulose derivatives such as hydroxyethyl, cellulose, carboxymethyl cellulose and cellulose sulfates, saccharide derivatives such as sodium alginate, starch derivatives and homo- or copolymers such as polyvinyl alcohol, partial acetalized polyvinyl alcohol, poly-N-vinylpyrrolidone, polyacrylic acid, polymethacrylic acid, polyacrylamide, polyvinylimidazole and polyvinylpyrazole.

Regarding the gelatins, lime-treated gelatins as well as acid-treated gelatins and enzyme-treated gelatins may be used. These are described in *Bull. Soc. Sci. Phot. Japan*, No. 16, page 30 (1966). In addition, hydrolyzed gelatins or enzyme-decomposed gelatins may also be used.

The block copolymer and the fluorescent whitening agent of the present invention are preferably incorporated in the same photographic layer. If, however, they are incorporated in different layers, it is preferred that the layer containing the block copolymer is positioned further from the support than the fluorescent whitening agent-containing layer.

The photographic emulsion layers of the present photographic light-sensitive materials may contain any silver halide such as silver bromide, silver bromoiodide, silver bromochloroiodide, silver bromochloride and silver chloride. In particular, the preferred silver halides are silver bromochloride and silver bromochloroiodide which do not contain silver iodide, or if any, contains 3 mol% or less silver iodide.

The silver halide particles in the photographic emulsion may be so-called regular particles having a regular crystalline form such as a cubic, octahedral or tetradecahedral form or may be particles having a spherical or the like irregular crystalline form or having a twin plane or the like crystal defect. The particles may also be composite particles comprising the above-described different crystal forms.

The silver halide particles may be fine, having a particle size of 0.1 micron or less, or may be large, having a particle size of up to 10 microns. They may form a monodispersed emulsion having a narrow particle distribution or a polydispersed emulsion having a broad particle distribution.

The silver halide photographic emulsions which may be used in the present invention may be prepared in a conventional manner by known methods such as those described in *Research Disclosure* (*RD*), No. 17643 (December, 1978), pp. 22–23 "I. Emulsion Preparation and Types" and RD, No. 18716 (November, 1979), p. 648.

Further, the present photographic emulsions may be prepared by other known methods such as those described in *Chimie et Physique Photographique* (written by. P. Glafkides and published by Paul Montel in 1967), *Photographic Emulsion Chemistry* (written by G. F. Duffin and published by Focal Press in 1966) and *Making and Coating Photographic Emulsion* (written by V. L. Zelikman, et al. and published by Focal Press in 1964). Specifically, any acid method, neutral method or ammonia method may be used. In addition, a one-side mixture method, a simultaneous mixture method or a combination thereof may be used for the reaction of a soluble silver salt and a soluble halide in the presence of a water-soluble high molecular substance-containing solution such as gelatin solution. A so-called reversed admixture method in which silver halide particles are formed in the presence of an excess silver ion may also be used.

A so-called controlled double jet method may also be used. This method is a type of simultaneous mixture method where the pAg value in the liquid phase to form silver halide particles is kept constant.

According to this method, an emulsion containing silver halide particles having a nearly regular crystalline form and a nearly uniform particle size may be obtained.

Two or more kinds of silver halide emulsions which have been separately prepared may be blended and used.

In the preparation of the silver halide, at least a part of gelatin may be substituted by the block copolymer of the present invention.

The aforesaid silver halide emulsion comprising regular particles may be obtained by properly controlling the pAg value and the pH value in the formation of the particles. The details are described in *Photographic Science and Engineering*, Vol. 6, pp. 159–165 (1962), *Journal of Photographic Science*, Vol. 12, pp. 242–251 (1964), U.S. Pat. No. 3,655,394 and British Patent 1,413,748.

The monodispersed emulsion is typically an emulsion comprising silver halide particles having a larger average particle diameter than about 0.1 micron, where at least 95% by weight of the particles have a particle diameter falling within the range of the average particle diameter of ±40%. Emulsions containing silver halide particles having an average particle diameter of 0.25 to 2 microns where at least 95% by weight of the particles or at least 95% of the number of the particles have a particle diameter falling within the range of the average particle diameter of ±20% may also be used in the present invention. The manufacture of the emulsions are described in U.S. Pat. Nos. 3,574,628, 3,655,394 and British Patent 1,413,748. The monodispersed emulsions as described in Japanese Patent Application (OPI) Nos. 8600/73, 39027/76, 83097/76, 137133/78, 48521/78, 99419/79, 37635/83 and 49938/83 are preferably used in the present invention.

The silver halide particles to be used in the present invention may be tabular particles having an aspect ratio of 5 or more. The tabular particles may easily be prepared by known methods such as those described in *Photographic Science and Engineering* (written by Gutoff), Vol. 14, pp. 248–257 (1970), U.S. Pat. Nos. 4,434,226, 4,414,310, 4,443,048, 4,439,520, and British Patent 2,112,157. The use of the tabular particles is preferable, since they result in the improvement of the color sensitization efficiency by sensitizer dyes, the improvement of the graininess and the increment of the sharpness, as described in the above-mentioned U.S. Pat. No. 4,434,226.

The silver halide particles in the emulsion may have a uniform constitution, may comprise different inner and outer halogen compositions or may comprise a layer constitution. Such emulsion particles are described in British Patent 1,027,146, U.S. Pat. Nos. 3,505,068, 4,444,877 and Japanese Patent Application (OPI) No. 143331/85. In addition, the silver halide particles may be epitaxial comprising different halogen compositions as bonded by epitaxial bond, or as the case may be, these may contain compounds other than silver halides, such as silver rhodanide or lead oxide, as bonded therewith. These emulsion particles are described in U.S. Pat. Nos. 4,094,684, 4,142,900 and 4,459,353, British Patent 2,038,792, U.S. Pat. Nos. 4,349,622, 3,295,478, 4,433,501, 4,463,087, 3,656,962 and 3,852,067 and Japanese Patent Application (OPI) No. 162540/84.

An emulsion comprising a mixture of particles with different crystal forms may be used in the present invention.

The emulsions of the present invention are generally those which have been physically ripened, chemically ripened and/or spectrally sensitized. Additives which may be used in the steps of physical ripening, chemical ripening and spectral sensitization are described in RD, No. 17643 and RD, No. 18716. The relevant parts contained therein are listed in the following Table.

Conventional photographic additives may be used in the photographic materials of the present invention. These additives are also described in the two publications listed above with the relevant parts thereof listed in the following Table.

| No. | Kind of Additives | RD 17643 | RD 18716 |
|---|---|---|---|
| 1 | Chemical Sensitizer | p. 23 | p. 648, right column |
| 2 | Sensitivity Enhancement | | p. 648, right column |
| 3 | Spectral Sensitizer, Supersensitizer | pp. 23–24 | from p. 648, right column to p. 649, right column |

-continued

| No. | Kind of Additives | RD 17643 | RD 18716 |
|---|---|---|---|
| 4 | Whitener | p. 24 | |
| 5 | Antifogging Agent, Stabilizer | pp. 24–25 | p. 649, right column |
| 6 | Light Absorbent, Filter Dye, Ultraviolet Absorbent | pp. 25–26 | from p. 649, right column to p. 650, left column |
| 7 | Stain Inhibitor | p. 25, right column | p. 650, from left to right column |
| 8 | Color Image Stabilizer | p. 25 | |
| 9 | Hardening Agent | p. 25 | p. 651, left column |
| 10 | Binder | p. 26 | p. 651, left column |
| 11 | Plasticizer, Lubricant | p. 27 | p. 650, right column |
| 12 | Coating Aid, Surfactant | pp. 26–27 | p. 650, right column |
| 13 | Antistatic Agent | p. 27 | p. 650, right column |

In order to obtain color images in the present invention, various color couplers may be used as the dye-forming compounds. Useful color couplers are cyan, magenta and yellow coloring couplers. Typical examples of these couplers are naphthol or phenol compounds, pyrazolone or pyrazoloazole compounds and ring-cleaved or heterocyclic ketomethylene compounds.

The color couplers to be incorporated in the photographic materials are preferably nondiffusible, such as by containing a ballast group or by being polymerized. 2-Equivalent color couplers where the coupling active position is substituted by a removing group are preferred to 4-equivalent color couplers where the coupling position is a hydrogen atom, since the silver amount to be coated may be reduced. Couplers capable of forming coloring dyes with a pertinent diffusibility, non-coloring couplers, DIR couplers capable of releasing a development inhibitor in the coupling reaction and couplers capable of releasing a development accelerator may also be used.

Typical examples of yellow couplers which may be used in the present invention are oil-protected acylacetamide couplers. Specific examples thereof are described in U.S. Pat. Nos. 2,407,210, 2,875,057 and 3,265,506. 2-Equivalent yellow couplers are particularly preferably used in the present invention. Typical examples thereof are oxygen atom-removing type yellow couplers such as those described in U.S. Pat. Nos. 3,408,194, 3,447,928, 3,933,501 and 4,022,620; and nitrogen atom-removing yellow couplers as described in Japanese Patent Publication No. 10739/83, U.S. Pat. Nos. 4,401,752 and 4,326,024, RD, No. 18053 (April, 1979), British Patent 1,425,020, and German Patent Application (OLS) Nos. 2,219,917, 2,261,361, 2,329,587 and 2,433,812. α-Pivaloylacetanilide couplers are good in the fastness, especially to light, of the formed dyes. α-Benzoylacetanilide couplers are good in the high color density of the formed dyes.

Magenta couplers which may be used in the present invention are oil-protected indazolone or cyanoacetyl couplers, preferably pyrazoloazole couplers such as 5-pyrazolone or pyrazolotriazole couplers. Among the 5-pyrazolone couplers, those whose 3-position is substituted by an arylamino group or an acylamino group are preferred because of the hue and the color density of the formed dyes. Typical examples of these couplers are described in U.S. Pat. Nos. 2,311,082, 2,343,703, 2,600,788, 2,098,573, 2,062,653, 3,152,896 and 3,936,015. Regarding the removing groups of the 2-equivalent 5-pyrazolone couplers, nitrogen atom-removing groups as described in U.S. Pat. No. 4,310,619 and arylthio groups as described in U.S. Pat. No. 4,351,897 are preferred. In addition, ballast group-containing 5-pyrazolone couplers as described in European Patent 73,636 are preferred, as forming color images of high color density.

Pyrazoloazole couplers which may be used in the present invention include pyrazolobenzimidazoles as described in U.S. Pat. No. 3,061,432, preferably pyrazolo[5,1-c][1,2,4]triazoles as described in U.S. Pat. No. 3,725,067, pyrazolotetrazoles as described in RD, No. 24220 (June, 1984) and pyrazolopyrazoles as described in RD, No. 24230 (June, 1984). In particular, imidazo[1,2-b]pyrazoles as described in European Patent 119,741 are preferred because the yellow side absorption of the formed dyes is small and the like fastness thereof is high. Pyrazolo[1,5-b][1,2,4]-triazoles as described in European Patent 119,860 are particularly preferred.

Cyan couplers which may be used in the present invention are oil-protected naphthol and phenol couplers. Typical examples thereof are naphthol couplers as described in U.S. Pat. No. 2,474,293, preferably oxygen atom-removing 2-equivalent naphthol couplers as described in U.S. Pat. Nos. 4,052,212, 4,146,396, 4,228,233 and 4,296,200. Specific examples of phenol couplers are given in U.S. Pat. Nos. 2,369,929, 2,801,171, 2,772,162 and 2,895,826.

Cyan couplers which are fast to moisture and temperature are preferably used in the present invention, and typical examples thereof are phenol cyan couplers having a higher alkyl group than an ethyl group in the meta-position of the phenol nucleus (see U.S. Pat. No. 3,772,002), 2,5-diacylamino-substituted phenyl couplers (see U.S. Pat. Nos. 2,772,162, 3,758,308, 4,126,396, 4,334,011 and 4,327,173, German Patent Application (OLS) No. 3,329,729 and Japanese Patent Application No. 42671/83), and phenol couplers having 2-phenylureido group and 5-acylamino group (see U.S. Pat. Nos. 3,446,622, 4,333,999, 4,451,559 and 4,427,767).

Couplers which may form colored dyes with pertinent diffusibility may also be co-sued. Regarding such couplers, specific examples of magenta couplers are described in U.S. Pat. No. 4,366,237 and British Patent 2,125,570. Suitable yellow, magenta and cyan couplers are described in European Patent 96,570 and German Patent Application (OLS) No. 3,234,533.

The dye-forming couplers and other special couplers as described in the above explanation may form dimers or more polymers, except for those forming diffusible color dyes. Typical examples of polymerized dye-forming couplers are described in U.S. Pat. Nos. 3,451,820 and 4,080,211. Examples of polymerized magenta couplers are described in British Patent 2,102,173 and U.S. Pat. No. 4,367,282.

Regarding the incorporation of the couplers into the layers of the present photographic materials, two or more kinds of different couplers may together be incorporated in the same light-sensitive layer or the same compound may be incorporated in two or more different layers for the purpose of satisfying the necessary characteristics of the materials.

The couplers may be incorporated into the photographic materials by means of various known dispersion methods. Typical methods include solid dispersion methods, alkali dispersion methods, preferably a latex dispersion method, and more precisely an oil-in-water dispersion method. According to the oil-in-water dispersion method, the coupler is first dissolved in either the aforesaid high boiling organic solvent having a boiling point of 175° C. or higher or a so-called auxiliary solvent having a low boiling point or in a mixture of these solvents. The resulting solution is then finely dispersed in water or in an aqueous medium such as a gelatin aqueous solution in the presence of a surfactant. In the emulsification and dispersion, the block copolymer of the present invention may be used in place of the gelatin or together with the gelatin.

The standard amount of the color coupler to be used is 0.001 to 1 mol per 1 mol of the light-sensitive silver halide. Preferably, the amount of the yellow coupler is 0.01 to 0.5 mol, the amount of the magenta coupler is 0.003 to 0.3 mol and the amount of the cyan coupler is 0.002 to 0.3 mol.

In the photographic light-sensitive materials of the present invention, the photographic emulsion layers and other layers are coated on a flexible support such as plastic film, paper or cloth or a rigid support such as glass, ceramic or metal, which are generally used in conventional photographic materials.

In particular, the reflective supports as described in the aforesaid RD, No. 17643 (page 28, XVII-C) and RD, No. 18716 (from page 647, right hand column to page 648, left hand column) are preferably used in the present invention.

The present invention may be applied to various light-sensitive materials. Typical examples thereof are color negative films for general use or for movies, color reversal films for slides or televisions, color papers, color positive films and color reversal papers. The present invention may further be applied to black-and-white photographic light-sensitive materials formed by three color coupler admixture, as described in RD, No. 17123 (July, 1978).

The color developer to be used for the development of the present photographic materials is preferably an aqueous alkaline solution comprising a main component of an aromatic primary amine color developing agent. The color developing agent is preferably a p-phenylenediamine compound, and typical examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and sulfates, hydrochlorides and p-toluenesulfonates thereof.

The color developers generally contain a pH buffer such as an alkali metal carbonate, borate or phosphate or a development inhibitor or antifogging agent such as a bromide, an iodide, a benzimidazole, a benzothiazole or a mercapto compound.

The color developer may not substantially contain benzyl alcohol. This means that the benzyl alcohol concentration in the color developer is 2 ml/l or less, preferably 0.5 ml/l or less, and more preferably the color developer does not contain any benzyl alcohol.

The photographic emulsion layer is, after color development, generally bleached. The bleaching treatment may be carried out simultaneously with the fixation treatment or may be carried out separately therefrom. Examples of bleaching agents which may be used include polyvalent metal compounds such as iron (III), cobalt (III), chromium (VI) or copper (II) compounds and peracids, quinones and nitroso compounds. Typical bleaching agents are ferricyanides, bichromates, organic complexes of iron (III) or cobalt (III) with an organic acid, for example, an aminopolycarboxylic acid, such as ethylenediaminetetraacetic acid, diethylenetriaminepentaacetic acid, nitrilotriacetic acid, 1,3-diamino-2-propanoltetraacetic acid, citric acid, tartaric acid or malic acid, persulfates, manganates and nitrosophenols. In particular, ethylenediaminetetraacetic acid-/iron (III) complex and persulfates are preferred in view of the possibility of rapid processing and the reduction of environmental pollution. The ethylenediaminetetraacetic acid/iron (III) complex is especially effective both in an independent bleaching solution and in a combined bleaching and fixing bath.

After the desilvering step (bleaching fixation or fixation), the material is rinsed and/or stabilized. In the rinsing step and the stabilization step, various compounds may be used for various purposes. For instance, it is known to add a germicide or antifungal agent for preventing the growth of various kinds of bacteria, fungi and algae. For this, compounds as described in *J. Antibact. Antifung. Agents,* Vol. 11, No. 5, pp. 207–223 (1983) and *Antibacterial and Antifungal Chemistry* (written by H. Horiguchi), may be used. Also, the compounds and methods described in Japanese Patent Application (OPI) Nos. 8543/82, 58143/82, 97530/82, 105145/83, 134636/83, 91440/84, 126533/84, 184344/84, 184336/84, 239250/85, 239751/85, 247241/85, 260952/85, 2149/86, 28947/86 and 28945/86 and Japanese Patent Application (OPI) No. 35446/86 and Japanese Patent Application No. 105487/85 may be adopted.

In particular, isothiazolone derivatives (such as 2-octyl-4-isothiazolin-3-one and 5-chloro-2-methyl-4-isothiazolin-3-one), sulfanylamide derivatives (such as sulfanylamide) and benzotriazole derivatives (such as benzotriazole, 5-methylbenzotriazole and 5-chlorobenzothiazole) are useful.

For the purpose of improving the image stability after processing, it is known to add various kinds of chelating agents. Suitable chelating agents include inorganic phosphonic acids, organic carboxylic acids, aminopolycarboxylic acids and organic phosphonic acids. Compounds and methods as described in Japanese Patent Application (OPI) Nos. 8543/82, 197540/82, 14834/83, 134636/83, 126533/84, 184343/84, 184344/84, 184345/84, 185336/84, 135942/85, 238832/85, 239748/85, 239749/85, 239750/85, 239751/85, 242458/85, 262161/85, 4047/86, 4050/86, 4051/86, 4052/86, 4053/86, 4054/86, 28942/86 and 28945/86 may also be adopted therefor. In particular, ethylenediaminetetraacetic acid, diethylenetriaminepentaacetic acid, nitrilotriacetic acid, 1-hydroxyethylidene-1,1'-diphosphonic acid and ethylenediaminetetramethylphosphonic acid are useful.

Metal compounds may be used together with these chelating agents. For example, bismuth compounds (Japanese Patent Application (OPI) No. 134636/83), Ba, Ca, Ce, Co, In, La, Mn, Ni, Pb, Ti, Sn, Zn, Zr compounds (Japanese Patent Application (OPI) No. 184344/84) and Mg, Al, Sr compounds (Japanese Patent Application (OPI) No. 185336/84) may be used. In particular, Bi, Ca, Mg, Al compounds are preferred.

Further, in order to efficiently carry out the rinsing step, a surfactant may be used (refer to Japanese Patent Application (OPI) No. 197540/82). In order to remove harmful components, various means may be utilized in the processing, which include a method for contact with an ion exchange resin (Japanese Patent Application (OPI) No. 220345/85), a method for back penetration (Japanese Patent Application (OPI) No. 241053/85), a method for the contact with active charcoal, clay substances, polyamide high molecular weight compounds, polyurethane high molecular weight compounds, phenol resins, epoxy resins, hydrazido group-containing high molecular weight compounds, polytetrafluoroethylene-containing high molecular weight compounds, monoesters of mono- or polyhydric alcohol/methacrylic acid or polyesters of polyhydric alcohol/methacrylic acid copolymer (Japanese Patent Application (OPI) No. 263151/85) and electrodialysis (Japanese Patent Application (OPI) No. 28949/86).

In addition, a method for irradiation using ultraviolet rays or a method for the impartation of a magnetic field may be utilized for the purpose of preventing the growth of bacteria and fungi. In the case of a continuous processing, methods as described in Japanese Patent Application Nos. 233651/85, 235133/85, 263941/85, 4048/86, 4049/86, 4055/86, 4056/86, 4057/86, 4058/86 and 4060/86 may be used.

Any other fluorescent whitening agent and hardener than the aforesaid additives may be added to the rinsing and stabilization baths.

As the film pH regulator after the processing, an ammonium salt such as ammonium chloride, ammonium nitrate, ammonium sulfate, ammonium phosphate, ammonium sulfite or ammonium thiosulfate is preferably added for the purpose of improving the image stability.

Regarding the addition of the aforesaid additives, one or more kinds of the same or different compounds may be used in accordance with the use and the object of the materials. Regarding the amount of the additives, it is preferred to use the minimum amount of the additive which is required for attaining the object in view of the state of the emulsion film of the photographic material after processing, such as stickiness.

In the rinsing or stabilization step, a multistage countercurrent means using two or more tanks is preferred to reduce the amount of the replenisher. The amount of the replenisher is preferably 0.1 to 50 times, more preferably 3 to 30 times, of the amount of the solution as fed from the preceding bath, per the unit area of the photographic material.

The time for the rinsing or the stabilization process in the present invention varies depending upon the kind of the photographic materials to be processed and the processing conditions. The time is generally 20 seconds to 2 minutes, preferably 20 seconds to 1 minute and 30 seconds.

The temperature in the rinsing or stabilization step is 20° to 45° C., preferably 25° to 40° C., more preferably 30° to 35° C.

In order to elevate the rinsing efficiency in the rinsing or stabilization process, the processing solution is preferably circulated and stirred. In particular, such method where the liquid stream is forcedly directed towards the emulsion film surface of the photographic material (for example, gas stirring or liquid spraying) is preferred.

The silver halide color photographic materials of the present invention are especially useful in a process where the amount of rinsing water is to be extremely reduced.

The silver halide color photographic materials of the present invention may contain a color developer for the simplification and acceleration of the processing of the materials. For the incorporation of the developer, various kinds of color developer precursors are preferably used.

The silver halide color photographic materials of the present invention may contain, if necessary, various kinds of 1-phenyl-3-pyrazolidones for the purpose of accelerating the color development.

The processing solutions are used at 10° C. to 50° C. in the present invention. The temperature of 33° C. to 38° C. is standard, and as the case may be, the temperature may be elevated higher for the purpose of accelerating the processing and reducing the processing period. Alternatively, the temperature may be lowered for the purpose of improving the image quality or improving the stability of the processing solution. Processing by the use of a cobalt intensifier or a hydrogen peroxide intensifier, as described in German Patent 2,226,770 or U.S. Pat. No. 3,674,499, may be carried out for reducing the amount of silver in the photographic material.

If necessary, the processing baths may be equipped with a heater, temperature sensor, liquid surface level sensor, circulation pump, filter, floating lid and/or a squeezer.

The present invention will be explained in greater detail by reference to the following examples. These examples, however, are not intended to be interpreted as limiting the scope of the present invention.

The silver halide emulsion for the blue-sensitive layer, as used in the following Examples 1 through 3, was prepared as follows:

| | |
|---|---|
| Solution (1): | |
| $H_2O$ | 1,000 ml |
| NaCl | 5.5 g |
| Gelatin | 32 g |
| Solution (2): | |
| Sulfuric Acid (1 N) | 20 ml |
| Solution (3): | |
| Silver halide solvent having the following formula (1%) | 3 ml |

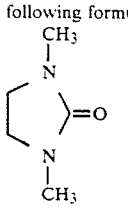

| | |
|---|---|
| Solution (4): | |
| KBr | 0.18 g |
| NaCl | 8.51 g |
| $H_2O$ to make | 130 ml |
| Solution (5): | |
| $AgNO_3$ | 25 g |
| $NH_4NO_3$ (50%) | 0.5 ml |
| $H_2O$ to make | 130 ml |
| Solution (6): | |
| KBr | 0.70 g |
| NaCl | 34.06 g |
| $K_2IrCl_6$ (0.001%) | 0.7 ml |
| $H_2O$ to make | 285 ml |
| Solution (7): | |
| $AgNO_3$ | 100 g |
| $NH_4NO_3$ (50%) | 2 ml |
| $H_2O$ to make | 285 ml |

Solution (1) was heated to 75° C., and Solution (2) and Solution (3) were added thereto. Afterwards, Solution (4) and Solution (5) were simultaneously added thereto in the course of 60 minutes. After 10 minutes, Solution (6) and Solution (7) were simultaneously added in the course of 25 minutes. After 5 minutes from the addition, the temperature of the reaction solution was lowered for demineralization. A water and gelatin dispersion was added to adjust the pH value of the mixture to 6.2 to obtain a monodispersed emulsion of cubic silver bromochloride particles having an average particle size of 1.02 microns, a variation coefficient (value of standard deviation as divided by average particle size: s/d) of 0.08 and a silver bromide content of 1 mol%. Gold was added in an amount of $1.0\times10^{-4}$ mol/Ag-mol, and the emulsion was optimally chemically sensitized with sodium thiosulfate.

The silver halide emulsion for the green-sensitive layer was prepared as follows:

| | |
|---|---|
| Solution (8): | |
| $H_2O$ | 1,000 ml |
| NaCl | 5.5 g |
| Gelatin | 32 g |
| Solution (9): | |
| Sulfuric Acid (1 N) | 24 ml |
| Solution (10): | |
| The same silver halide solvent as Solution (2) (1%) | 3 ml |
| Solution (11): | |
| KBr | 0.11 g |
| NaCl | 10.94 g |
| $H_2O$ to make | 220 ml |
| Solution (12): | |
| $AgNO_3$ | 32 g |
| $H_2O$ to make | 200 ml |
| Solution (13): | |
| KBr | 0.45 g |
| NaCl | 43.83 g |
| $K_2IrCl_6$ (0.001%) | 4.5 ml |
| $H_2O$ to make | 600 ml |
| Solution (14): | |
| $AgNO_3$ | 128 g |
| $H_2O$ to make | 600 ml |

Solution (8) was heated to 56° C., and Solution (9) and Solution (10) were added thereto. Afterwards, Solution (11) and Solution (12) were simultaneously added thereto in the course of 10 minutes. After further 10 minutes, Solution (13) and Solution (14) were simultaneously added in the course of 8 minutes. After 5 minutes from the addition, the temperature of the reaction solution was lowered for demineralization. A water and gelatin dispersion was added to adjust the pH value of the mixture to 6.2 to obtain a monodispersed emulsion of cubic silver bromochloride particles having an average particle size of 0.45 micron, a variation coefficient of 0.08 and a silver bromide content of 0.5 mol%. $4.1\times10^{-4}$ mol/Ag-mol of chloroauric acid was added to the resulting emulsion for gold sensitization.

In the same manner as the above process, with the exception that the composition of Solution (11) and Solution (13) and the reaction temperature were varied, another monodispersed emulsion of cubic silver bromochloride particles having an average particle size of 0.51 micron, a variation coefficient of 0.07 and a silver bromide content of 1 mol% was obtained. This emulsion was subjected to gold and sulfur sensitization to obtain an emulsion of a red-sensitive layer. Gold was added in an amount of $4.1\times10^{-4}$ mol/Ag-mol, and the emulsion was optimally chemically sensitized with sodium thiosulfate.

EXAMPLE 1

A Preparation of Fluorescent Whitening Agent

A solution formed by dissolving 8 g of the aforesaid Fluorescent Whitening Compound No. 24 in 100 ml of n-dioctyl phthalate and 200 ml of ethyl acetate was added to 800 ml of 12% gelatin aqueous solution containing 7 g of dodecylbenzenesulfonate at about 600° C., and the whole was vigorously stirred in a homogenizer to obtain an emulsified dispersion.

30 g of the previously prepared green-sensitive emulsion was taken out, and 30 g of an emulsified dispersion of a magenta coupler as shown below and 20 g of the aforesaid fluorescent whitening agent-containing emulsion were added thereto. Next, pyridinium salt of anhydro-9-ethyl-5,5'-diphenyl-3,3'-bis(2-sulfoethyl)-oxacarbocyanine, potassium bromide, surfactant, 4-hydroxy-6-methyl-1,3,3a,7-tetraazaindene, sodium salt of 2-hydroxy-4,6-dichlorotriazine, gelatin and water were added thereto to obtain an emulsion, the content of the gelatin being 8% by weight of the total weight.

In the same manner as the above process, with the exception that the gelatin was partially substituted by the block copolymer of the present invention (acrylic acid-modified polyvinyl alcohol copolymer having a modification degree of 17%), various emulsions as shown in the following Table 1 were prepared. The binder compositions of the emulsions are also shown in Table 1.

Next, the emulsion and a gelatin-containing aqueous solution (which were separately prepared for the protective layer) were coated on a polyethylene laminate paper support to form a two-layer coat, the former emulsion layer being positioned nearer to the support than the latter protective layer. Thus, eight kinds of samples were obtained in all.

The samples were subjected to wedge exposure with a light of 256 lux at a color temperature of 5,400° K., and then developed with a developer as shown below. The resulting eight kinds of strips, each having a magenta image, were tested for the measurement of the density to obtain the sensitivity to white light. The non-exposed samples were developed with the following developer, and the fluorescence strength of each sample was measured by using an 850 Type Spectrophotofluorometer (by Hitachi) with an exciting light having a wavelength of 400 nm. The results are given in Table 1.

After the above processing, each sample was left at 50° C. and 80% RH for 7 days, and the fluorescence strength thereof was again measured. The deterioration of the fluorescence strength was calculated, and the results given in Table 1.

The results shown in Table 1 prove that the partial substitution of the gelatin binder with the polyvinyl alcohol block copolymer of the present invention is effective for increasing the fluorescence strength of the photographic material, after processing, and for preventing the deterioration of the fluorescence strength of the material, when preserved in a high moisture atmosphere.

TABLE 1

| Sample No. | Binder Composition in Emulsion Layer (wt %): Amount of Block Copolymer | Amount of Gelatin | Relative Fluorescence Strength: Just after Processing | After Forced Deterioration (50° C. 80% RH. 7 days) |
|---|---|---|---|---|
| 101 | 0 | 100 | 1.00 | 0.81 |
| 102 | 2 | 98 | 1.01 | 0.83 |
| 103 | 5 | 95 | 1.05 | 0.87 |
| 104 | 10 | 90 | 1.08 | 0.99 |
| 105 | 20 | 80 | 1.13 | 1.01 |
| 106 | 30 | 70 | 1.17 | 1.04 |
| 107 | 40 | 60 | 1.18 | 1.04 |
| 108 | 50 | 50 | 1.03 | 0.85 |

Magenta Coupler M-1:

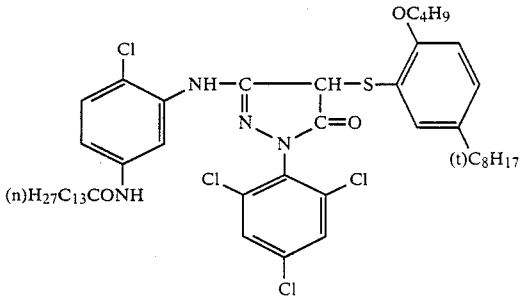

(0.017 mol to 1 mol of silver)

Process:

| Processing Step | Temperature (°C.) | Time (sec) |
|---|---|---|
| Color Development | 35 | 45 |
| Bleaching Fixation | 35 | 45 |
| Rinse 1 | 35 | 20 |
| Rinse 2 | 35 | 20 |
| Rinse 3 | 35 | 20 |
| Drying | 80 | 60 |

| Processing Solutions: | |
|---|---|
| **Color Developer:** | |
| Triethanolamine | 10 g |
| N,N-Diethylhydroxylamine | 4 g |
| Fluorescent Whitening Agent (4,4'-diaminostilbene) | 3.0 g |
| Sodium Sulfite | 0.2 g |
| Potassium Carbonate | 30 g |
| EDTA.2Na.2$H_2O$ | 2 g |
| Potassium Bromide | 0.01 g |
| 4-Amino-3-methyl-N-ethyl-N-[β-(methanesulfonamido)ethyl]-p-phenylenediamine.Sulfate | 5.0 g |
| Sodium Chloride | 20 g |
| Water to make | 1,000 ml |
| pH | 10.25 |
| **Bleaching Fixer:** | |
| EDTA.Fe(III).$NH_4$.2$H_2O$ | 60 g |
| EDTA.2Na.2$H_2O$ | 4 g |
| Ammonium Thiosulfate (70%) | 120 ml |
| Sodium Sulfite | 16 g |
| Acetaldehyde/Sulfurous Acid Adduct | 10 g |
| Glacial Acetic Acid | 7 g |
| Water to make | 1,000 ml |
| pH | 5.5 |
| **Rinsing Solution:** | |
| EDTA.2Na.2$H_2O$ | 0.4 g |
| Water to make | 1,000 ml |
| pH | 7.0 |

EXAMPLE 2

In the same manner as that of Sample No. 104 of Example 1, with the exception that the fluorescent whitening agent as shown in Table 2 was used, and using the same binder composition as Sample No. 104 of Table 1, the samples of Table 2 were prepared. The samples were developed and the fluorescence strength of each was measured. In comparison, samples each having the same binder composition as Sample No. 101 of Example 1 and containing the fluorescent whitening agent of Table 2 were formed. These were processed in the same manner, and the fluorescence strength just after processing and that after being left under high moisture condition were measured. The results of Table 2 prove that the system of the present invention attained a remarkable fluorescent whitening effect.

-continued

| | |
|---|---|
| Gelatin | 0.90 |
| Di-t-octylhydroquinone | 0.05 |
| Solvent for the above (DBP) | 0.10 |
| Third Layer: Green-Sensitive Layer | |
| Silver bromochloride emulsion | 0.45 (silver) |
| Magenta coupler (*2) | 0.35 |
| Solvent for the above (TOP) | 0.44 |
| Discoloration inhibitor (*3/*4) | 0.05/0.10 |
| Gelatin | 1.00 |
| Fourth Layer: Ultraviolet Absorbent Intermediate Layer | |
| Ultraviolet absorbent (*5/*6/*7) | 0.06/0.25/0.25 |

TABLE 2

| Sample No. | Kind of Fluorescent Whitening Agent | Binder Composition in Emulsion Layer (amount of block copolymer) (wt %) | Relative Fluorescence Strength: Just after Processing | Relative Fluorescence Strength: After Forced Deterioration (50° C., 80% RH, 7 days) | Notes |
|---|---|---|---|---|---|
| 201 | No. 23 | 0 | 1.00 | 0.75 | Comparison |
| 202 | " | 10 | 1.05 | 0.97 | Invention |
| 203 | No. 25 | 0 | 1.00 | 0.77 | Comparison |
| 204 | " | 10 | 1.04 | 0.99 | Invention |
| 205 | No. 26 | 0 | 1.00 | 0.86 | Comparison |
| 206 | " | 10 | 1.04 | 1.02 | Invention |
| 207 | No. 28 | 0 | 1.00 | 0.87 | Comparison |
| 208 | " | 10 | 1.07 | 1.06 | Invention |
| 209 | No. 29 | 0 | 1.00 | 0.87 | Comparison |
| 210 | " | 10 | 1.08 | 1.06 | Invention |
| 211 | No. 30 | 0 | 1.00 | 0.90 | Comparison |
| 212 | " | 10 | 1.11 | 1.08 | Invention |

EXAMPLE 3

A light-sensitive film comprising the following seven layers was coated on a polyethylene duplex laminated paper support to form a color photographic materials. The polyethylene as coated with the first layer contained titanium dioxide and a slight amount of ultramarine.

Constitution of Light-Sensitive Film

The number corresponding to each component means the coated amount as represented by the unit of "g/m$^2$", and the amount of the silver halide is represented by the amount of the silver contained in the coated amount.

The silver bromochloride emulsions for the blue-sensitive layer, green-sensitive layer and red-sensitive layer were those previously prepared.

| | |
|---|---|
| First Layer: Blue-Sensitive Layer | |
| Silver bromochloride emulsion | 0.30 (silver) |
| Yellow coupler (*1) | 0.70 |
| Solvent for the above (TNP) | 0.15 |
| Gelatin | 1.20 |
| Second Layer: Intermediate Layer | |
| Solvent for the above (TNP) | 0.20 |
| Gelatin | 1.5 |
| Fifth Layer: Red-Sensitive Layer | |
| Silver bromochloride emulsion | 0.20 (silver) |
| Cyan coupler (*8/*9) | 0.2/0.2 |
| Coupler solvent (TNP/DBP) | 0.10/0.20 |
| Gelatin | 0.9 |
| Sixth Layer: Ultraviolet Absorbent Intermediate Layer | |
| Ultraviolet absorbent (*5/*6/*7) | 0.06/0.25/0.25 |
| Solvent for the above (DBP) | 0.20 |
| Gelatin | 1.5 |
| Seventh Layer: Protective Layer | |
| Gelatin | 1.5 |
| Hardener (H-1) | 0.4 |

DBP is dibutyl phthalate, TOP is tri(n-octyl phosphate), TNP is tri(n-nonyl phosphate), and (H-1) is the following compound:

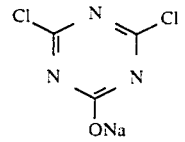

Other compounds are as follows:

Yellow Coupler (*1):

-continued
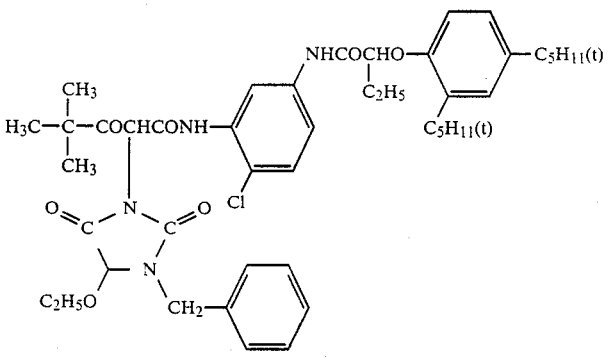
Magenta Coupler (*2):
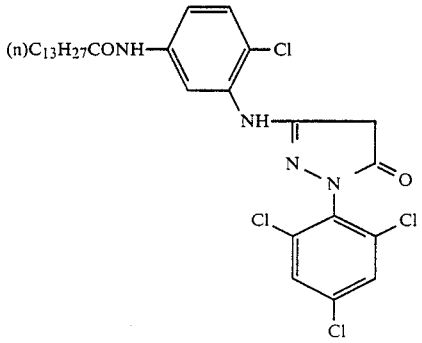
Discoloration Inhibitor (*3):
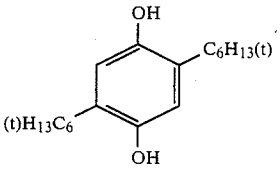
Discoloration Inhibitor (*4):
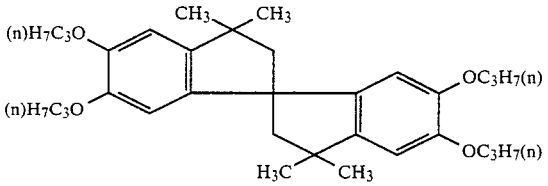
Ultraviolet Absorbent (*5):
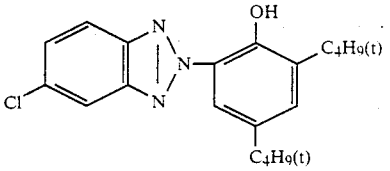
Ultraviolet Absorbent (*6):
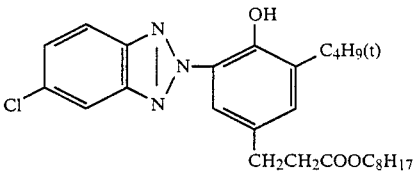
Ultraviolet Absorbent (*7):
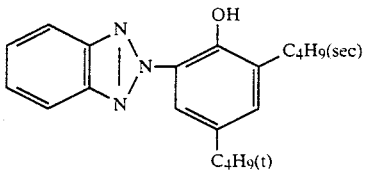
Cyan Coupler (*8):
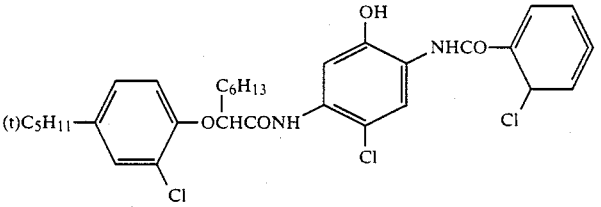
Cyan Coupler (*9)

-continued

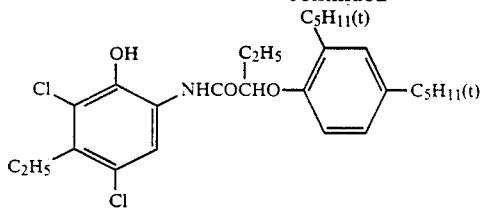

The following spectral sensitizer dyes were used in each emulsion layer:

Blue-Sensitive Emulsion Layer:

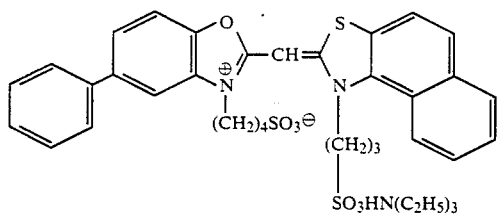

Green-Sensitive Emulsion Layer:

Pyridinium 3,3'-di(2-sulfoethyl)-5,5'diphenyl-9-ethyloxacarbocyanine ($2.5 \times 10^{-4}$ mol per 1 mol of silver halide)

Red-Sensitive Emulsion Layer:

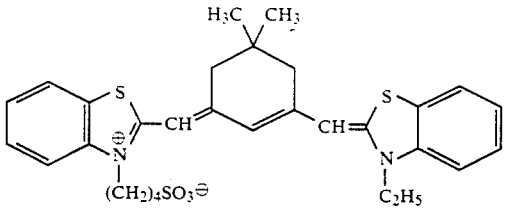

The following anti-irradiation dyes were used in each emulsion layer:

Green-Sensitive Emulsion Layer:

-continued

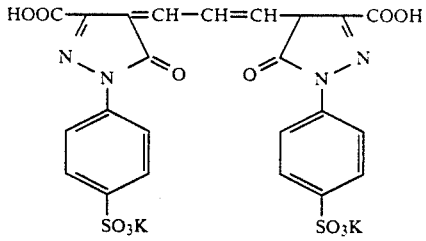

Red-Sensitive Emulsion Layer:

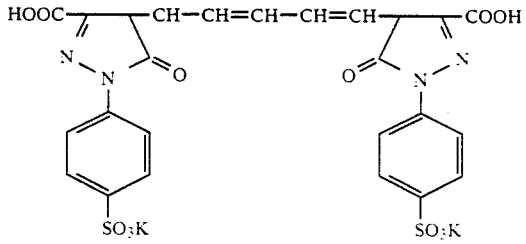

The photographic light-sensitive material thus obtained was called Sample No. 301.

In the same manner as Sample No. 301, with the exception that the block copolymer of the present invention (the same copolymer as used in Example 1) was added in the seventh layer of Sample No. 301 with the amount of the block copolymer as added being shown in Table 3, and that the pH of the layer was properly controlled, Sample Nos. 302 through 318 were formed.

These samples were developed with the same color developer as that used in Example 1, which, however, contained the fluorescent whitening agent as shown in Table 3. The fluorescence strength of each sample was measured just after development and after exposure to high moisture atmosphere described in Table 3. The results are given in Table 3.

TABLE 3

| Sample No. | Amount of Block Copolymer in 7th Layer (wt %) | Fluorescent Whitening Agent in Developer: Kind | Fluorescent Whitening Agent in Developer: Amount Added (g/l) | Relative Fluorescence Strength: Just after Processing | Relative Fluorescence Strength: After Forced Deterioration (50° C., 80% RH, 7 days) |
|---|---|---|---|---|---|
| 301 | 0 | No. 1 | 1.0 | 1.00 | 0.76 |
| 302 | 10 | " | " | 1.09 | 0.99 |
| 303 | 30 | " | " | 1.13 | 1.03 |
| 304 | 0 | No. 2 | 1.2 | 1.00 | 0.74 |
| 305 | 10 | " | " | 1.07 | 0.97 |
| 306 | 30 | " | " | 1.11 | 1.01 |
| 307 | 0 | No. 5 | 0.8 | 1.00 | 0.78 |
| 308 | 10 | " | " | 1.09 | 1.01 |
| 309 | 30 | " | " | 1.12 | 1.02 |
| 310 | 0 | No. 12 | 1.0 | 1.00 | 0.77 |
| 311 | 10 | " | " | 1.07 | 0.99 |
| 312 | 30 | " | " | 1.11 | 1.04 |
| 313 | 0 | No. 16 | 0.7 | 1.00 | 0.79 |
| 314 | 10 | " | " | 1.08 | 0.98 |

TABLE 3-continued

| Sample No. | Amount of Block Copolymer in 7th Layer (wt %) | Fluorescent Whitening Agent in Developer: Kind | Fluorescent Whitening Agent in Developer: Amount Added (g/l) | Relative Fluorescence Strength: Just after Processing | Relative Fluorescence Strength: After Forced Deterioration (50° C., 80% RH, 7 days) |
|---|---|---|---|---|---|
| 315 | 30 | " | " | 1.12 | 1.01 |
| 316 | 0 | No. 22 | 0.9 | 1.00 | 0.78 |
| 317 | 10 | " | " | 1.08 | 0.98 |
| 318 | 30 | " | " | 1.12 | 1.01 |

EXAMPLE 4

In the same manner as Sample No. 301 of Example 3, with the exception that the silver halide emulsion and the spectral sensitizer dye in each layer were varied as shown below, another photographic material was formed.

Silver Halide Emulsion for Blue-Sensitive Layer:

Silver bromochloride emulsion having silver bromide content of 80 mol%.

Silver Halide Emulsion for Green-Sensitive Layer:

Silver bromochloride emulsion having silver bromide content of 70 mol%.

Silver Halide Emulsion for Red-Sensitive Layer:

Silver bromochloride emulsion having silver bromide content of 50 mol%.

Spectral sensitizer dyes were as follows:

Blue-Sensitive Emulsion Layer:

Triethylammonium 4-{5-chloro-2-[5-chloro-3-(4-sulfonatobutyl)benzothiazolin-2-ylidenemethyl]-3-benzothiazolio}butanesulfonate ($2\times10^{-4}$ mol per 1 mol of silver halide).

Green-Sensitive Emulsion Layer:

Sodium 3,3'-di(γ-sulfopropyl)-5,5'-diphenyl-9-ethyloxacarbocyanine ($2.5\times10^{-4}$ mol per 1 mol of silver halide).

Red-Sensitive Emulsion Layer:

Sodium 3,3'-di(γ-sulfopropyl)-9-methylthiadicarbocyanine ($2.5\times10^{-4}$ mol per 1 mol of silver halide).

This photographic material was called Sample No. 401.

Next, in the same manner as Sample No. 401, with the exception that the block copolymer of the present invention (A) or (B) was added to the seventh layer of Sample No. 401, the amount of the block copolymer as added being shown in Table 4, and that the pH of the layer was properly controlled, Sample Nos. 402 through 411 were formed. The samples were subjected to gradation exposure for sensitometry with an enlarger (Fuji Color Head 609), and then processed in accordance with the following processing steps (A), (B), (C), (D) or (E) for development. After processing, the samples were dried with hot air at 80° C.

(A)

| Processing Step | Temperature (°C.) | Time (min) |
|---|---|---|
| Development | 33 | 3.5 |
| Bleaching Fixation | 33 | 1.5 |
| Rinse | 28–35 | 3.0 |

The composition of the processing solution used in each step was as follows:

| Developer: | |
|---|---|
| 3Na Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N-ethyl-N-[β-(methanesulfonamido)ethyl]-p-phenylenediamine Sulfate | 5.0 g |
| $Na_2CO_3$ (monohydrate) | 30 g |
| Water to make | 1 liter (pH 10.1) |
| **Bleaching Fixer:** | |
| Ammonium Thiosulfate (54 wt %) | 150 ml |
| $Na_2SO_3$ | 15 g |
| $NH_4$ Fe(EDTA) | 55 g |
| EDTA · 2Na | 4 g |
| Water to make | 1 liter (pH 6.9) |

(B) Standard Type Processing:

| Processing Step | Temperature (°C.) | Time |
|---|---|---|
| Color Development | 38 | 3 min 30 sec |
| Bleaching Fixation | 30–35 | 1 min 30 sec |
| Rinse 1 | 30–35 | 1 min 00 sec |
| Rinse 2 | 30–35 | 1 min 00 sec |
| Rinse 3 | 30–35 | 1 min 00 sec |
| Drying | 70 | 1 min 30 sec |

The composition of the processing solution used in each step was as follows:

| Color Developer: | |
|---|---|
| Benzyl Alcohol | 15 ml |
| Diethylene Glycol | 15 ml |
| Potassium Sulfite | 2.0 g |
| Potassium Bromide | 1.1 g |
| Sodium Chloride | 0.2 g |
| Potassium Carbonate | 30.0 g |
| Hydroxylamine Sulfate | 3.0 g |
| Hydroxyethoxyiminodiacetic Acid | 4 g |
| 1-Hydroxyethylidene-1,1'-diphosphonic Acid | 1 g |
| Magnesium Chloride | 0.8 g |
| 3-Methyl-4-amino-N-ethyl-N-(β-methanesulfonamidoethyl)aniline Sulfate | 5.5 g |
| Fluorescent Whitening Agent (4,4'-diaminostilbenedisulfonic acid derivative) | 1.0 g |
| Potassium Hydroxide | 2.0 g |
| Water to make | 1 liter (pH 10.20) |
| **Bleaching Fixer:** | |
| Ammonium Ethylenediaminetetraacetate/Iron(III)·Dihydrate | 60 g |
| Ethylenediaminetetraacetic Acid | 3 g |
| Ammonium Thiosulfate (70% solution) | 100 ml |
| Ammonium Sulfite (40% solution) | 27.5 ml |
| Water to make | 1 liter |
| Potassium carbonate or glacial acetic acid to make | pH of 7.1 |
| **Rinsing Solution:** | |
| 1-Hydroxyethylidene-1,1'-diphosphonic Acid (60%) | 1.6 ml |

-continued

| | |
|---|---|
| Bismuth Chloride | 0.35 g |
| Polyvinyl pyrrolidone | 0.25 g |
| Aqueous Ammonia (26%) | 2.5 ml |
| 3Na Nitrilotriacetate | 1.0 g |
| 5-Chloro-2-methyl-4-isothiazolin-3-one | 50 mg |
| 2-Octyl-4-isothiazolin-3-one | 50 mg |
| Fluorescent Whitening Agent (4,4'-diaminostilbene type) | 1.0 g |
| Water to make | 1,000 ml |
| Potassium hydroxide or hydrochloric acid to make | pH of 7.5 |

(C) Economical Processing by Reduction of Rinsing Time:

| Processing Step | Temperature (°C.) | Time |
|---|---|---|
| Color Development | 33 | 3 min 30 sec |
| Bleaching Fixation | 33 | 1 min 30 sec |
| Rinse 1 | 30 | 40 sec |
| Rinse 2 | 30 | 40 sec |
| Rinse 3 | 30 | 40 sec |
| Drying | 80 | 50 sec |

The composition of the processing solution as used in each step was as follows:

| | |
|---|---|
| Color Developer: | |
| Diethylenetriaminetetraacetate | 3.0 g |
| Benzyl Alcohol | 15 ml |
| Diethylene Glycol | 10 ml |
| Sodium Sulfite | 2.0 g |
| Hydroxylamine Sulfate | 4.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Fluorescent Whitening Agent (4,4'-diaminostilbene type) | 1.0 g |
| Water to make | 1,000 ml (pH 10.10) |
| Bleaching Fixer: | |
| Ammonium Thiosulfate (70% solution) | 150 ml |
| Sodium Sulfite | 18 g |
| Ammonium Ethylenediaminetetraacetate/Iron(III) | 55 g |
| 2Na Ethylenediaminetetraacetate | 5 g |
| Water to make | 1,000 ml (pH 6.70) |
| Rinsing Solution: | |
| 1-Hydroxyethylidene-1,1'-diphosphonic Acid (60%) | 2.0 ml |
| Ammonium Alum | 0.5 g |
| Benzotriazole | 1.0 g |
| Sulfanylamide | 100 mg |
| Aqueous Ammonia (26%) | 1.8 ml |
| Potassium hydroxide to make | pH of 7.5 |

(D) Rapid Processing

| Processing Step | Temperature (°C.) | Time |
|---|---|---|
| Color Development | 38 | 1 min 40 sec |
| Bleaching Fixation | 30-34 | 1 min 00 sec |
| Rinse 1 | 30-34 | 20 sec |
| Rinse 2 | 30-34 | 20 sec |
| Rinse 3 | 30-34 | 20 sec |
| Drying | 70-80 | 50 sec |

The composition of the processing solution used in each step was as follows:

| | |
|---|---|
| Color Developer: | |
| Diethylenetriaminepentaacetate | 3.0 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30.0 g |

-continued

| | |
|---|---|
| N-Ethyl-N-(β-methanesulfonamidoethyl)-3-methyl-4-aminoaniline Sulfate | 3.5 g |
| Hydroxylamine Sulfate | 3.0 g |
| Fluorescent Whitening Agent (4,4'-diaminostilbene type) | 1.0 g |
| Water to make | 1,000 ml (pH 10.25) |
| Bleaching Fixer: | |
| Ammonium Thiosulfate (70%) | 200 ml |
| Sodium Sulfite | 18 g |
| Ammonium Ethylenediaminetetraacetate/Iron(III) | 65 g |
| 2Na.Ethylenediaminetetraacetate | 5 g |
| Water to make | 1,000 ml |
| Aqueous ammonia and hydrochloric acid to make | pH of 7.0 |
| Rinsing Solution: | |
| Ethylenediamine-N,N,N',N'-tetra-methylenephosphonate | 0.3 g |
| Benzotriazole | 1.0 g |
| Water to make | 1,000 ml |
| Sodium hydroxide to make | pH of 7.5 |

(E) Rapid Processing:

| Processing Step | Temperature (°C.) | Time (sec) |
|---|---|---|
| Color Development | 38 | 50 |
| Bleaching Fixation | 30-35 | 50 |
| Rinse 1 | 30-35 | 30 |
| Rinse 2 | 30-35 | 30 |
| Rinse 3 | 30-35 | 30 |

The composition of the processing solution used in each step was as follows:

| | |
|---|---|
| Color Developer: | |
| Ethylenetriaminetetraacetate | 3 g |
| Potassium Bromide | 1.0 g |
| Potassium Carbonate | 30 g |
| N-Ethyl-N-(β-methanesulfonamidoethyl)-3-methyl-4-aminoaniline Sulfate | 5.5 g |
| Sodium Sulfite | 1.7 g |
| Hydroxylamine Sulfate | 3.0 g |
| Fluorescent Whitening Agent (4,4'-diaminostilbene type) | 1.0 g |
| Water to make | 1,000 ml |
| KOH to make | pH of 10.20 |
| Bleaching Fixer: | |
| Ammonium Thiosulfate (70%) | 200 ml |
| Ammonium Ethylenediaminetetraacetate/Iron(III) | 60 g |
| 2Na.Ethylenediaminetetraacetate | 5 g |
| Sodium Sulfite | 15 g |
| Water to make | 1,000 ml |
| Aqueous ammonia and hydrochloric acid to make | pH of 7.0 |
| Rinsing Solution A: | |
| 2Na.Ethylenediaminetetraacetate | 0.5 g |
| Water to make | 1 liter |
| Rinsing Solution B: | |
| Sulfanylamide | 1.0 g |
| Water to make | 1 liter |
| Rinsing Solution C: | |
| 5-Chloro-2-methyl-4-isothiazolin-3-one | 30 mg |
| Water to make | 1 liter |
| Rinsing Solution D: | |
| Benzotriazole | 1.0 g |
| Ethylenediamine-N,N,N',N'-tetramethylene-phosphonate | 0.3 g |
| Water to make | 1,000 ml |
| KOH to make | pH of 7.5 |
| Rinsing Solution E: | |
| 1-Hydroxyethylidene-1,1'-diphosphonate (60%) | 1.6 ml |
| Bismuth Chloride | 0.35 g |
| Polyvinylpyrrolidone | 0.25 g |
| Aqueous Ammonia (26%) | 2.5 ml |

-continued

| | |
|---|---|
| 3Na.Nitrilotriacetate | 1.0 g |
| 5-Chloro-2-methyl-4-isothiazolin-3-one | 50 mg |
| 2-Octyl-4-isothiazolin-3-one | 50 mg |
| Fluorescent Whitening Agent (4,4'-diaminostilbene type) | 1.0 g |
| Water to make | 1,000 ml |
| Potassium hydroxide or hydrochloric acid to make | pH of 7.5 |

Next, the dried samples were left at room temperature and 55% RH for 2 days and then in 80% RH for 5 minutes. The appearance (roughness) of the surface of each sample was observed.

The results are given in Table 4, which prove that the samples containing the block copolymer (A) or (B)(*) in the gelatin protective layer had a high surface gloss after processing by processes (A), (B), (C), (D) or (E), while the surface gloss of the comparative sample containing no block copolymer was noticeably deteriorated by processes (B), (C), (D) or (E).

(*) Block Copolymer (A): Acrylic acid-modified polyvinyl alcohol copolymer (modification degree: 17%)
Block Copolymer (B): Acrylic acid-modified polyvinyl alcohol copolymer (modification degree: 23%)

TABLE 4

| Sample No. | Composition of 7th Layer (wt %) Kind of Block Copolymer | Amount of Block Copolymer | Amount of Gelatin | Surface Gloss Process (A) | Process (B) | Process (C) | Process (D) | Process (E) | Note |
|---|---|---|---|---|---|---|---|---|---|
| 401 | — | — | 100 | — | — — — | — — — | — — — | — — — | Comparison |
| 402 | (A) | 2 | 98 | + | — | — | — | — | Invention |
| 403 | (A) | 5 | 95 | + + | + | + | + | + | " |
| 404 | (A) | 7 | 93 | + + + | + + | + + | + + | + + | " |
| 405 | (A) | 10 | 90 | + + + + | + + + | + + + | + + + | + + + | " |
| 406 | (A) | 20 | 80 | + + + | + + | + + | + + | + + | " |
| 407 | (B) | 2 | 98 | + | — | — | — | — | " |
| 408 | (B) | 5 | 95 | + + | + | + | + | + | " |
| 409 | (B) | 7 | 93 | + + + | + + | + + | + + | + + | " |
| 410 | (B) | 10 | 90 | + + + + | + + + | + + + | + + + | + + + | " |
| 411 | (B) | 20 | 80 | + + + | + + | + + | + + | + + | " |

Decrement of surface gloss in the order of (—) to (— — —)
Increment of surface gloss in the order of (+) to (+ + +)

EXAMPLE 5

In the same manner as Example 4, with the exception that the amount of each of the ultraviolet absorbent and the solvent (oil components) in the sixth layer was reduced to $\frac{2}{3}$, Sample No. 501 was formed.

Further, the block copolymer (B) was added to the 7th layer, the amount thereof being shown in Table 5 to form Sample Nos. 502 through 507. These samples were processed in the same manner as Example 4 and the surface gloss of each sample was evaluated analogously.

TABLE 5

| Sample No. | Amount of Block Copolymer (B) (wt %) | Amount of Gelatin (wt %) | Surface Gloss Process (A) | Process (B) | Process (C) | Process (D) | Process (E) | Note |
|---|---|---|---|---|---|---|---|---|
| 501 | — | 100 | — | — — — | — — — | — — — | — — — | Comparison |
| 502 | 1 | 99 | + | — | — | — | — | Invention |
| 503 | 2 | 98 | + + | + | + | + | + | " |
| 504 | 4 | 96 | + + + | + + | + + | + + | + + | " |
| 505 | 8 | 92 | + + + + | + + + | + + + | + + + | + + + | " |
| 506 | 16 | 84 | + + + | + + | + + | + + | + + | " |
| 507 | 32 | 68 | + + | + | + | + | + | " |

The effect of the present invention will now be summarized.

The addition of a fluorescent whitening agent or a dispersing oil has heretofore been proposed and tried to improve the duration of the fluorescence strength of photographic materials. These means, however, are still insufficient prior to the present invention. The aforesaid Table 1 through Table 5 prove that the co-use of a fluorescent whitening agent and a block copolymer is effective for the prevention of the decrement of the fluorescence strength of the photographic materials and for the increment of the background whiteness thereof. Consequently, the effect of the present invention is extremely surprising and unexpected.

As mentioned in the above explanation, the addition of polyvinyl pyrrolidone, polyvinyl alcohol or polyvinyl acetal, besides gelatin, to the binder in the fluorescent whitening agent-containing layer in the photographic material has been known to be used for elevating the fluorescence strength of the material. The effect of the present invention, however, is far superior to that of the known technique.

The reason why the addition of the present block copolymer (or "a water-soluble or water-dispersible block copolymer comprising one component of a polyvinyl alcohol type polymer and the other component of an ionic group-containing polymer") to the gelatin which is the main component of the binder is superior to the addition of the aforesaid conventional polymer thereto is because the present block copolymer is extremely highly compatible with the gelatin, the formed dry film is uniform and is stable against the variation of the environmental conditions, the fluorescence strength of the fluorescent whitening agent contained in the dry film is itensified and that the characteristics of the material are durable in the preservation for a long period of time.

Further, the surface gloss of the material may be kept high when preserved for a long period of time after the photographic processing, without substantial deterioration of the maximum color density. This effect may be attained even in so-called rinse-free processing or in processing where a color developer which is substantially free from benzyl alcohol is used.

A still further effect of the present invention is that the interlayer adhesion of the hydrophilic colloid layers is high.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive element comprising a support having thereon at least one light-sensitive silver halide emulsion layer and at least one light-insensitive layer, all of which layers contain an effective binding amount of hydrophilic colloid binder material, said binder material containing gelatin as a primary binder constituent, wherein at least one hydrophilic colloid binder containing layer of the element contains an oil component and wherein at least one hydrophilic colloid binder layer of the element contains a water-soluble polyacrylic acid and polyvinyl alcohol block copolymer in an amount of from 0.5 to about 40 percent by weight of the total solid content of gelatin.

2. A photographic light-sensitive element as in claim 1, wherein the layers are positioned on the support so that at least the layer furthest from the support contains the block copolymer.

3. A photographic light-sensitive element as in claim 1, wherein the support is a reflective support.

4. A photographic light-sensitive element as in claim 1, wherein each layer on the support includes a hydrophilic colloid.

5. A photographic light-sensitive element as in claim 1, wherein at least one of the layers is a hydrophilic colloid layer and further comprises an oil component and wherein the layer adjacent to the oil component-containing layer contains the block copolymer.

6. A photographic light-sensitive element as in claim 5, wherein the oil component is present in an amount ranging from 10 to 200 percent by weight of the hydrophilic colloid.

7. A photographic light-sensitive element as in claim 5, wherein the block copolymer-containing layer is also a hydrophilic colloid layer and is superposed over the oil component-containing layer.

8. A photographic light-sensitive element as in claim 1, wherein at least one of the layers is a hydrophilic colloid layer and further comprises a dye-forming compound and wherein the layer adjacent to the dye-containing layer contains the block copolymer.

9. A photographic light-sensitive element as in claim 4, wherein the block copolymer is present in an amount ranging from 2 to 10 percent by weight of the hydrophilic colloid.

10. A photographic light-sensitive element as in claim 5, wherein the oil component is at least one member selected from the group consisting of ultraviolet absorbents, organic solvents for dispersion, color stain inhibitors, color couplers, discoloration inhibitors, lubricants and surfactants.

11. A photographic light-sensitive element as in claim 1, wherein the polyvinyl alcohol polymer component of the copolymer is prepared from at least 50 mole percent vinyl alcohol.

12. A photographic light-sensitive element as in claim 1, wherein the polyvinyl alcohol polymer component of the copolymer is prepared from at least 70 mole percent vinyl alcohol.

13. A photographic light-sensitive element as in claim 1, wherein the acrylic acid monomer of the copolymer contains at least 0.5 mole percent of carboxyl groups.

14. A photographic light-sensitive element as in claim 1, wherein the acrylic acid monomer of the copolymer contains at least 1 mole percent of carboxyl groups.

15. A photographic light-sensitive element as in claim 1, wherein the acrylic acid monomer of the copolymer contains at least 2 mole percent of carboxyl groups.

16. A photographic light-sensitive element as in claim 1, wherein the weight ratio of the polyvinyl alcohol polymer component of the copolymer to the acrylic acid monomer of the copolymer is in the range of about 0.2 to 50.

17. A photographic light-sensitive element as in claim 1, wherein the weight ratio of the polyvinyl alcohol polymer component of the copolymer to the acrylic acid monomer of the copolymer is in the range of about 0.3 to 40.

18. A photographic light-sensitive element as in claim 1, wherein the weight ratio of the polyvinyl alcohol polymer component of the copolymer to the acrylic acid monomer of the copolymer is in the range of about 2 to 10.

19. A photographic light-sensitive element as in claim 1, wherein a fluorescent whitening agent is further incorporated in a hydrophilic colloid layer which is the same or different layer containing the block copolymer on a support.

20. A photographic light-sensitive element as in claim 19, wherein the support is a reflective support.

21. A photographic light-sensitive element as in claim 19, wherein said at least one of the layers which contains a fluorescent whitening agent is a light-sensitive layer.

22. A photographic light-sensitive element as in claim 19, wherein said at least one of the layers which contains a fluorescent whitening agent is the light-insensitive layer positioned furthest from the support.

23. A photographic light-sensitive element as in claim 1, wherein a fluorescent whitening agent and the block copolymer are incorporated in the same layer.

24. A photographic light-sensitive element as in claim 19, wherein the fluorescent whitening agent is present in an amount of 0.1 to 200 $mg/m^2$.

25. A photographic light-sensitive element as in claim 19, wherein the fluorescent whitening agent is present in an amount of 5 to 50 $mg/m^2$.

* * * * *